US007717424B2

(12) United States Patent
Sakakibara et al.

(10) Patent No.: US 7,717,424 B2
(45) Date of Patent: May 18, 2010

(54) SHEET CONVEYING DEVICE AND IMAGE SCANNING APPARATUS

(75) Inventors: Akihiro Sakakibara, Toyota (JP); Satoru Nakakita, Nagoya (JP); Yasuhito Bandai, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 561 days.

(21) Appl. No.: 11/683,217

(22) Filed: Mar. 7, 2007

(65) Prior Publication Data

US 2007/0210512 A1 Sep. 13, 2007

(30) Foreign Application Priority Data

Mar. 7, 2006 (JP) ..... 2006-061925

(51) Int. Cl.
*B65H 29/20* (2006.01)

(52) U.S. Cl. ..... 271/314; 271/212

(58) Field of Classification Search ..... 271/212, 271/314

See application file for complete search history.

(56) References Cited

U.S. PATENT DOCUMENTS 5,653,437 A * 8/1997 Inoue et al. ..... 271/178
6,488,279 B1 * 12/2002 Fukuda et al. ..... 271/314
2005/0194731 A1 9/2005 Ohama et al.
2005/0212195 A1 9/2005 Ohama et al.

FOREIGN PATENT DOCUMENTS

JP H06-321400 A 11/1994
JP H08-282897 A 10/1996
JP 2005247575 9/2005
JP 2005253013 9/2005

OTHER PUBLICATIONS

Japanese Patent Office, Office Action for Application No. 2006-061925, mailed Oct. 28, 2008 (partial translation; corresponds to above-captioned U.S. patent application).

* cited by examiner

*Primary Examiner*—Patrick Mackey
*Assistant Examiner*—Michael C McCullough
(74) *Attorney, Agent, or Firm*—Baker Botts L.L.P.

(57) ABSTRACT

A pair of discharge rollers is provided at a position most downstream in a conveying direction of a sheet conveying path defined by guide surfaces. The discharge rollers discharge a sheet from the sheet conveying path. A discharge chute portion, including upper and lower discharge guides, guides the discharged sheet toward a discharge tray. An elastic support piece is provided in the discharge chute portion and elastically urges a trailing edge of the discharged sheet toward the upper discharge guide. The pair of discharge rollers is arranged such that a direction in which the drive roller contacts the follower roller is inclined toward upstream in the conveying direction with respect to a direction of a normal line of a lower one of the guide surfaces that is located in the sheet conveying path at a position the most downstream in the conveying direction.

19 Claims, 25 Drawing Sheets

SHEET CONVEYING DEVICE AND IMAGE SCANNING APPARATUS

CROSS-REFERENCE TO RELATED APPLICATION

This application claims priority from Japanese Patent Application No. 2006-061925, filed on Mar. 7, 2006, the entire subject matter of which is incorporated herein by reference.

TECHNICAL FIELD

Aspects of the present invention relate to a sheet conveying device that conveys a sheet along a sheet conveying path to discharge the sheet to a discharge position, and an image scanning apparatus having the sheet conveying device. More particularly, the present invention relates to a sheet conveying device and an image scanning apparatus having a mechanism for stacking a plurality of sheets in layers by allowing a next sheet to be placed beneath a preceding discharged sheet.

BACKGROUND

Conventionally, in an apparatus such as a copying machine, a scanner, a printer, and a multi-function device having a plurality of functions for serving as such apparatuses, there is known a configuration being provided with an ADF (Auto Document Feeder) that conveys a sheet (an original document) from a feed tray to a discharge tray along a sheet conveying path. Examples of such configuration are proposed in JP-A-2005-247575 (counterpart U.S. patent application is published as US 2005/0212195 A1) and JP-A-2005-253013 (counterpart U.S. patent application is published as US 2005/0194731 A1). The ADF disclosed in JP-A-2005-247575 and JP-A-2005-253013 is schematically shown as ADF 130 in FIG. 23. A simple overview of the mechanism and operation of the ADF 130 will be described below.

The conventional ADF 130 shown in FIG. 23 has a sheet feeding mechanism 131 that separates a plurality of sheets (hereinafter, referred to as a "stack of sheets") placed on a feed tray 132 and sequentially feeds the stack of sheets to a sheet conveying path 138. The sheet feeding mechanism 131 is configured such that a feed chute portion 133 is formed monolithically from the feed tray 132, and a feed roller 134, a feed nip piece 135, a separation roller 136, and a separation nip piece 137 are arranged in the feed chute portion 133.

The feed roller 134 is rotatably arranged on a lower guide surface of the feed chute portion 133. The feed nip piece 135 is arranged on a portion of an upper guide surface of the feed chute portion 133 in a position facing the feed roller 134, such that the feed nip piece 135 is contactable with the teed roller 134. The feed nip piece 135 is urged toward the feed roller 134 to be in Contact with the feed roller 134 by an urging member that is not shown.

The stack of sheets placed on the feed tray 132 are urged toward the feed roller 134 by the feed nip piece 135 and a bottommost sheet of the stack of sheets that contacts the feed roller 134 is fed in a sheet feeding direction due to the rotation of the feed roller 134. In the configuration shown in FIG. 23, the sheets are placed on the feed tray 132 with its right face (face to be scanned) facing downward.

The separation roller 136 is rotatably arranged on the lower guide surface of the feed chute portion 133 to be spaced from the feed roller 134 in the sheet feeding direction. The separation nip piece 137 is arranged on the upper guide surface of the feed chute portion 133 that is a position facing the separation roller 136, such that the separation nip piece 137 contacts the separation roller 136. The separation nip piece 137 is urged toward the separation roller 136 to be in contact with the separation roller 136 by an urging member that is not shown. A sheet fed by the feed roller 134 is nipped between the separation roller 136 and the separation nip piece 137 and conveyed in the sheet feeding direction by the rotation of the separation roller 136.

The sheet conveying path 138 is configured to have a substantially U-lettered shape when viewed from a side of the ADF 130 and is provided at a position downstream with respect to the feed chute portion 133 in the sheet feeding direction. A conveying roller 139 is arranged on the sheet conveying path 138 and three pinch rollers 140 (140*a*, 140*b*, and 140*c*) are arranged on an outer circumference of the conveying roller 139. Each of the pinch rollers 140 are urged toward the conveying roller 139 by an urging member, which is not shown, to be in contact with the conveying roller 139.

A sheet fed to the sheet conveying path 138 by the sheet feeding mechanism 131 is conveyed along the sheet conveying path 138 while being nipped between the pinch roller 140*a*, which is disposed immediately upstream of a platen glass 142, and the conveying roller 139. The sheet is guided by a guide member 141 and conveyed onto the platen glass 142. At this time, an image formed on the sheet that is conveyed above the platen glass 142 is scanned by an image sensor 143 arranged below the platen glass 142.

The sheet having been scanned is conveyed upward while being nipped between the pinch roller 140*b*, which is disposed immediately downstream of the platen glass 142, and the conveying roller 139. At this time, the sheet is guided by a curved guide surface, which is not shown, and conveyed to perform a U-turn along an outer circumferential surface of the conveying roller 139.

The pinch roller 140*c* is arranged on the sheet conveying path 138 at a position most downstream. As shown in FIGS. 24A-24C, the pinch roller 140*c* is disposed vertically above the conveying roller 139 and supported by an outer guide 147 with the pinch roller 140*c* being urged toward the conveying roller 139 by a coil spring 146. A sheet is conveyed while being nipped between the pinch roller 140*c* and the conveying roller 139, to thereby be discharged to a discharge tray 144 from the sheet conveying path 138 through a discharge chute portion 145.

In the ADF 130 configured as described above, sheets are fed one by one from the stack of sheets placed faced down on the feed tray 132. The fed sheets are sequentially conveyed to the discharge tray 144 disposed above the feed tray 132. Accordingly, the sheets are stacked on the discharge tray 144 in an order (hereinafter, referred to as "reverse order") reverse to an original order initially being stacked. In order to prevent the sheets from being thus discharged in reverse order, the conventional ADF disclosed in JP-A-2005-247575 and JP-A-2005-253013 is provided with, as shown in FIG. 24, a plate spring piece 148 that lifts up the discharged sheet from a nip position that is configured between the pinch roller 140*c* and the conveying roller 139.

According to this configuration, the sheet S2 (hereinafter, referred to as a "subsequent sheet") that is discharged by the pinch roller 140*c* and the conveying roller 139 subsequent to the discharged sheet is guided such that a leading edge of the subsequent sheet S2 is placed, by the plate spring piece 148, beneath a trailing edge of the preceding discharged sheet S1 (hereinafter, referred to as a "preceding sheet") . Then, the subsequent sheet S2 is further conveyed, to thereby be discharged to slide beneath the preceding sheet S1. Accordingly, the sheets discharged onto the discharge tray 144 will be stacked in the original order.

According to the ADF 130 having the plate spring piece 148, the order of the discharged sheets is not reversed as described above. However, in the conventional ADF 130, concerns arise about the possible occurrence of an event that due to an amount of the preceding sheets stacked on the discharge tray 144, or an aged deterioration of the roller surface of the pinch roller 140*c*, the subsequent sheet may not be placed beneath the preceding sheets stacked on the discharge tray 144 and may be discharged between the stacked sheets or on the top of the stacked sheets.

For example, when the amount of sheets discharged on the discharge tray 144 increases, as shown in FIG. 25, a subsequent sheet S3 is prevented from advancing by the preceding sheets S1 and S2 that are already being discharged, and thus, the subsequent sheet S3 is immediately stopped after a conveying force applied by the nip roller 140*c* and the conveying roller 139 is lost. At this time, a trailing edge of the sheet S3 remains near the nip position. The trailing edge remaining near the nip position may be scraped upward by the pinch roller 140*c*, however, when the roller surface of the pinch roller 140*c* is in a slippery condition due to an aged deterioration, the trailing edge of the sheet S3 may not be scraped upward. When another subsequent sheet S4 is discharged with the trailing edge of the sheet S3 remaining near the nip position, the subsequent sheet S4 is discharged at a higher position than the preceding sheet S3, causing a problem that the order of the discharged sheets may not be the original order. In addition, the subsequent sheet S4 may collide with the trailing edge of the preceding sheets, thereby causing a jam of the sheets (paper jam).

SUMMARY

According to a first aspect of the present invention, there is provided a sheet conveying device including: a sheet conveying path that is defined by guide surfaces that face each other with a predetermined gap therebetween and through which a sheet is conveyed; a pair of discharge rollers that is provided at a position most downstream in a conveying direction of the sheet conveying path and discharges the sheet from the sheet conveying path, the discharge rollers including: a drive roller that rotates by a torque applied thereto; and a follower roller that contacts the drive roller and rotates in accordance with the rotation of the drive roller; a discharge chute portion that guides the sheet discharged by the discharge rollers toward downstream in the conveying direction, the discharge chute portion including an upper discharge guide and a lower discharge guide that face each other with a predetermined gap therebetween; an elastic support piece that is provided in the discharge chute portion and supports a trailing edge of the sheet discharged to the discharge chute portion while elastically urging the trailing edge toward the upper discharge guide; and a discharge tray that is provided continuously from the discharge chute portion and retains the sheet guided by the discharge chute portion. The pair of discharge rollers is arranged such that a direction in which the drive roller contacts the follower roller is inclined toward upstream in the conveying direction with respect to a direction of a normal line of a lower one of the guide surfaces that is located in the sheet conveying path at a position the most downstream in the conveying direction.

According to a second aspect of the present invention, there is provided an image scanning apparatus including: a sheet conveying device that conveys a sheet; and an image scanning device that scans an image formed on the sheet. The sheet conveying device includes: a sheet conveying path that is defined by guide surfaces that face each other with a predetermined gap therebetween and through which the sheet is conveyed; a pair of discharge rollers that is provided at a position most downstream in a conveying direction of the sheet conveying path and discharges the sheet from the sheet conveying path, the discharge rollers including: a drive roller that rotates by a torque applied thereto; and a follower roller that contacts the drive roller and rotates in accordance with the rotation of the drive roller; a discharge chute portion that guides the sheet discharged by the discharge rollers toward downstream in the conveying direction, the discharge chute portion including an upper discharge guide and a lower discharge guide that face each other with a predetermined gap therebetween; an elastic support piece that is provided in the discharge chute portion and supports a trailing edge of the sheet discharged to the discharge chute portion while elastically urging the trailing edge toward the upper discharge guide; and a discharge tray that is provided continuously from the discharge chute portion and retains the sheet guided by the discharge chute portion. The pair of discharge rollers is arranged such that a direction in which the drive roller contacts the follower roller is inclined toward upstream in the conveying direction with respect to a direction of a normal line of a lower one of the guide surfaces that is located in the sheet conveying path at a position the most downstream in the conveying direction. The image scanning device is disposed below a sheet scanning position along the sheet conveying path.

DESCRIPTION

An example of the present invention will be described below by referring to the accompanying drawings. It is to be understood that the following example is merely an example in which the present invention is embodied and, as a matter of course, the example can be appropriately modified without changing the spirit and scope of the present invention.

Figure 1:
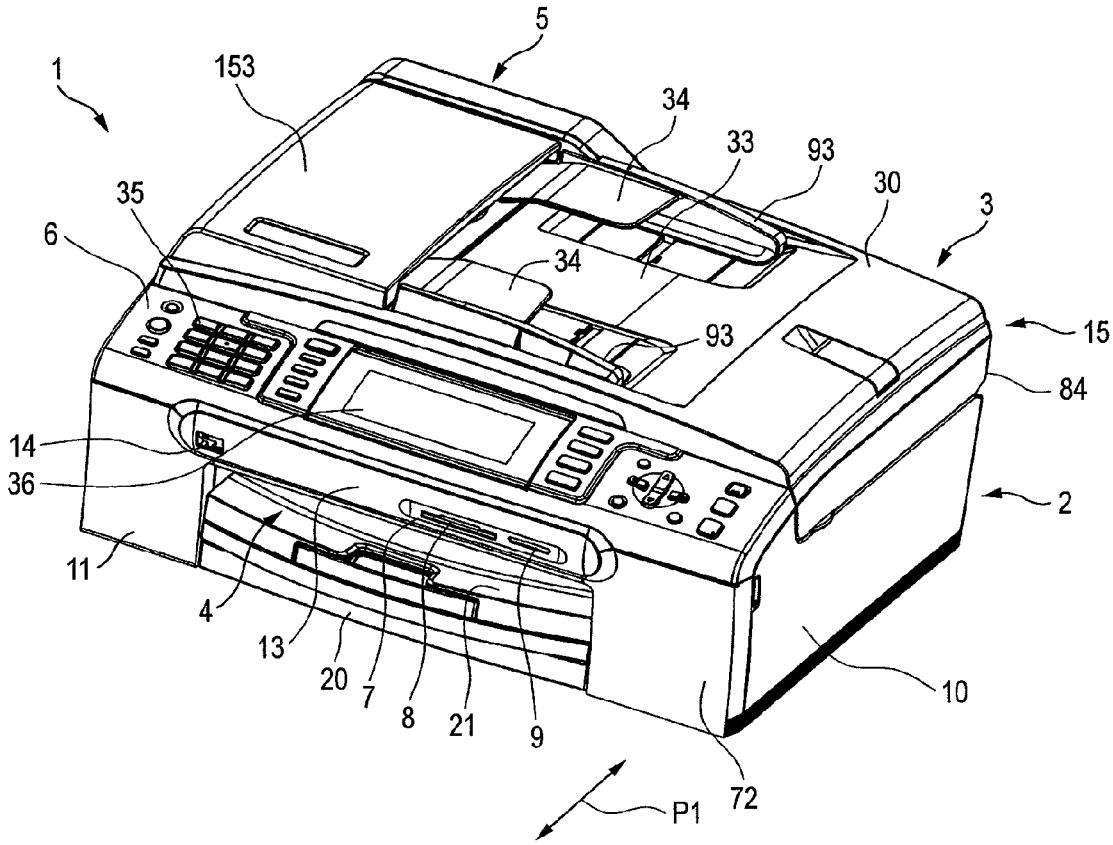
FIG. 1 is an external perspective view showing an external configuration of a multi-function device being provided with an ADF according to one example of the present invention.
Figure 2:
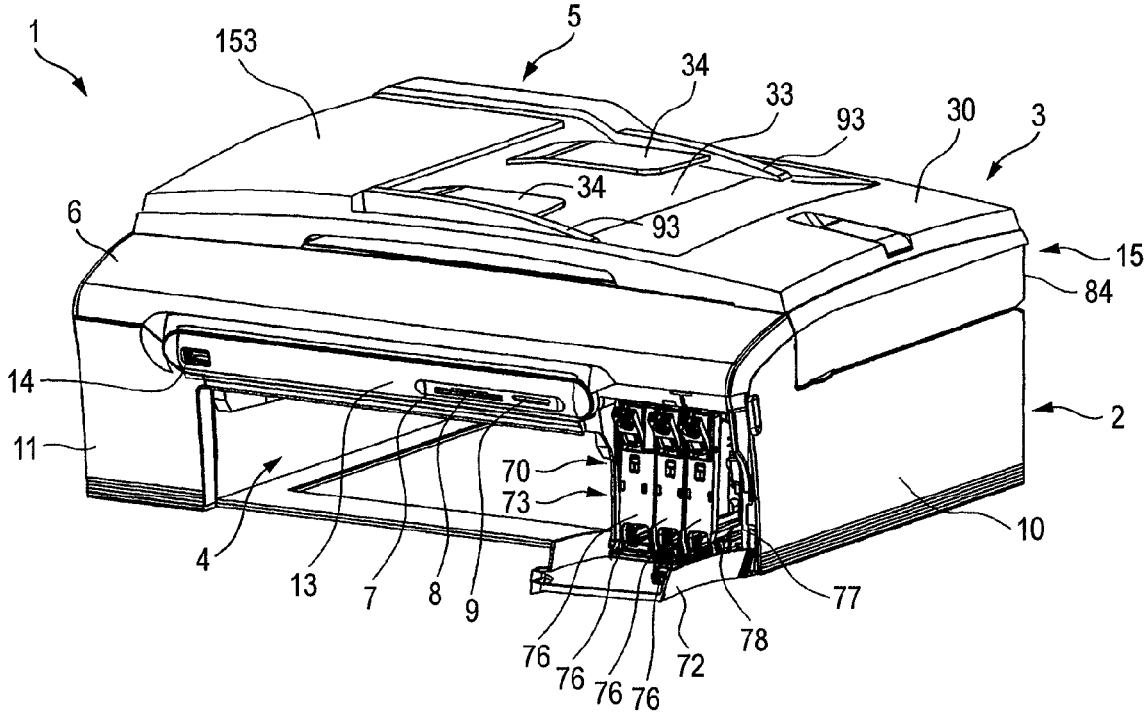
FIG. 2 is an external perspective view of the multi-function device showing a state in which a feed tray and a discharge tray is removed and a door for ink cartridges is opened.
Figure 3:
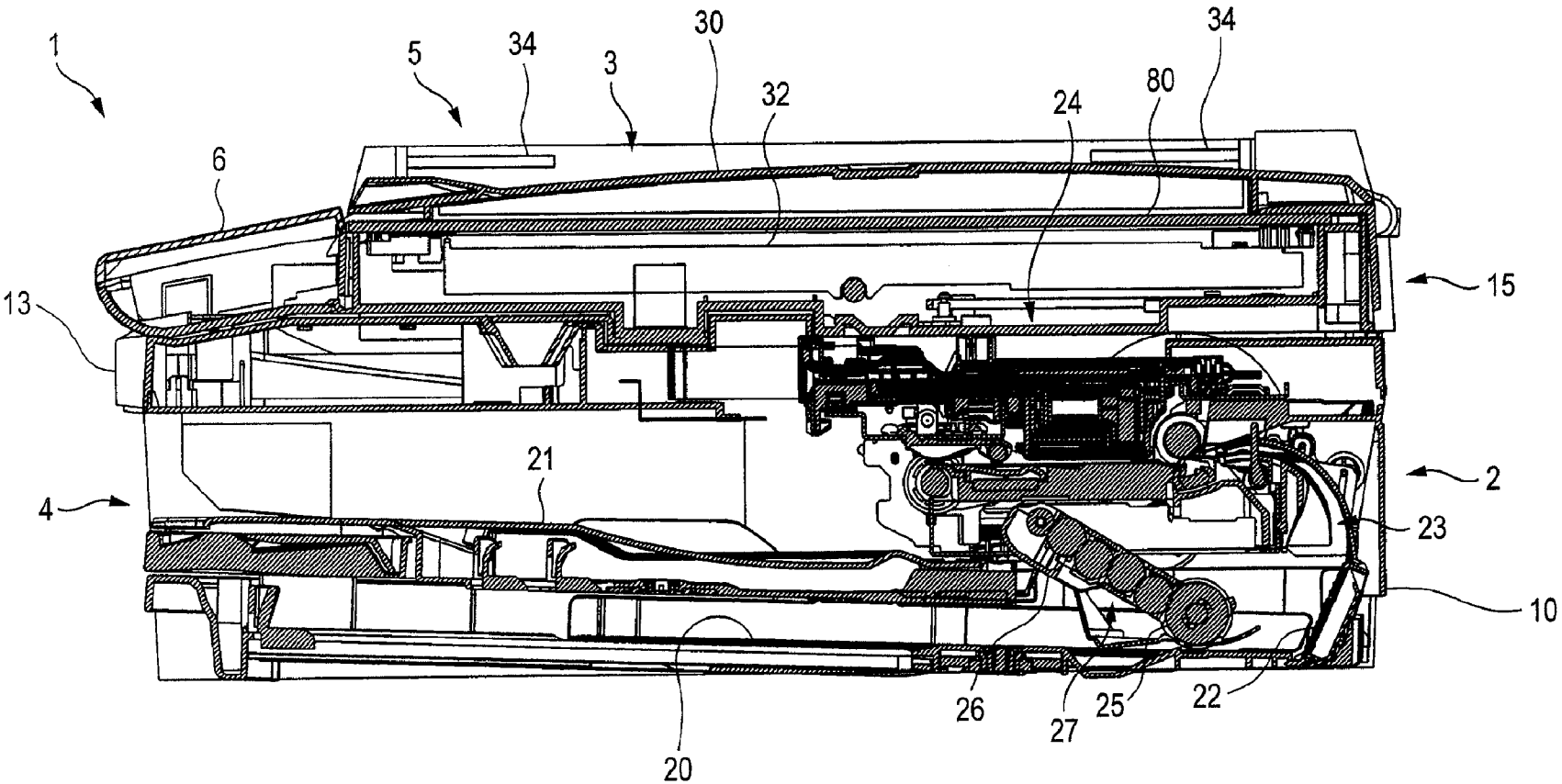
FIG. 3 is a vertical cross-sectional view showing an internal configuration of the multi-function device.

As shown in FIGS. 1-3, a multi-function device 1 according to an example of the present invention is a multi-function device (MFD) that is integrally provided with an ink-jet printing type printer unit 2 arranged at the bottom and a scanner unit 3 arranged above the printer unit 2. The multi-function device 1 has a plurality of functions including a printer function, a scanner function, a copy function, and a facsimile function. The scanner unit 3 of the multi-function device 1 serves as an image scanning apparatus according to the present invention, and an ADF (Auto Document Feeder) 5 provided in the scanner unit 3 serves as a sheet conveying device according to the present invention.

Note that functions other than the scanner function are arbitrary and the present invention may be implemented as a scanner that exclusively performs the scanner function. The ADF 5 may be taken as an independent device (i.e., a sheet conveying device). Thus, in this case, a scanner function is also arbitrary. In short, the present invention relates to an apparatus that conveys a sheet and thus can also be applied as an apparatus that conveys a recording sheet to a predetermined scanning position not only in a scanner but also in a printer or a copying machine, for example.

When performing the printer function, the multi-function device 1 is connected to a computer, which is not shown, and the printer unit 2 forms an image on a recording sheet based on image data or text data transmitted from the computer. When the multi-function device 1 is connected to an external device, such as a digital camera, the printer unit 2 forms an image on the sheet based on image data input from the external device. When a storage device, such as a memory card and a USB (Universal Serial Bus) memory, is attached to the multi-function device 1, the printer unit 2 forms an image on the recording sheet based on image data stored in the storage device.

When performing the scanner function, image on the sheet is scanned by the scanner unit 3 as image data, and the image data is transferred to a computer connected to the multi-function device 1 by wire or wirelessly. The scanned image data can also be transferred to and stored in various storage media such as a memory card and a USB memory.

When performing the copy function, image data scanned by the scanner unit 3 is formed on the recording sheet by the printer unit 2. When performing the facsimile function, image data read by the scanner unit 3 is transmitted as facsimile signal through a communication network such as a telephone line. Received facsimile signal is formed on the recording sheet by the printer unit 2.

As shown in FIGS. 1 and 2, an external appearance of the multi-function device 1 is substantially formed in a box shape having width and depth being larger than height. The printer unit 2 provided at a lower part of the multi-function device 1 has a housing 10 that serves as a frame of the printer unit 2. A front panel 11 faced to a front side of the housing 10 has an opening 4 formed thereon.

A feed tray 20 and a discharge tray 21 are provided in the opening 4 in a state where the discharge tray 21 is stacked above on the feed tray 20. A connector panel 13 is arranged above the opening 4. An opening 73 (see FIG. 2) is provided at a rightmost side, in a widthwise direction, on the front panel 11. A door 72 that opens and closes the opening 73 is pivotably provided to be forwardly openable around an axis provided near a lower end of the door 72. As shown in FIG. 2, a refill unit 70 that retains ink cartridges that stores inks is mounted in the opening 73.

An operation panel 6 that allows a user to operate the printer unit 2 and the scanner unit 3 is provided at a top front portion of the multi-function device 1. The operation panel 6 is provided with various operation buttons 35 and a liquid crystal display 36 that are appropriately arranged. The multi-function device 1 is operated based on an instruction (instruction signal) inputted by an operation input by the user through the operation panel 6. When the multi-function device 1 is connected to a computer, the multi-function device 1 is also operated based on an instruction (instruction signal) transmitted from the computer via a printer driver or a scanner driver.

As shown in FIGS. 1 and 2, the connector panel 13 where various connectors are disposed is provided at the front of the multi-function device 1. The connector panel 13 is arranged above the opening 4 formed in the front panel 11. The connector panel 13 is formed in a shape that is elongated in a widthwise direction (a direction perpendicular to the sheet in FIG. 3) of the multi-function device 1.

Note that, the operation buttons 35, the liquid crystal display 36, the feed tray 20, and the discharge tray 21 are omitted in FIG. 2.

A slot portion 7 is disposed at a rightmost portion of the connector panel 13. The slot portion 7 allows various types of memory cards to be attached therein to establish an electrical connection between a control unit 100 (see FIG. 12) of the multi-function device 1 and the memory cards. In the present example, the memory cards are card-type storage device having a flash memory as a storage medium. In the slot portion 7, to allow different types of memory cards to be attached, a first card slot 8 and a second card slot 9 being configured as different types of slots are horizontally arranged.

The first and second card slots 8 and 9 allow the memory cards to be inserted therein and removed therefrom in a direction perpendicular to the front panel 11, i.e., a depth direction of the multi-function apparatus 1 (a direction indicated by an arrow P1 in FIG. 1). As shown in FIGS. 1 and 2, the first and second card slots 8 and 9 are arranged laterally so that insertion and removal of the memory cards is performed with the front and back faces of the memory cards to be horizontal.

In the multi-function device 1, when a memory card is inserted into the slot portion 7, the control unit 100 (see FIG. 12) of the multi-function device 1 accesses the memory card, whereby image data stored in the memory card is read. When the image data is read, information about the image data, e.g., data names or preview images, is displayed on the liquid crystal display 36 of the operation panel 6. When the user arbitrarily selects image data based on the information displayed on the liquid crystal display 36, the selected image data is transferred to the printer unit 3 and the image data is formed on a recording sheet. Operations by the user to select image data is input through the operation panel 6.

A USB connector 14 is disposed at a leftmost portion of the connector panel 13. The USB connector 14 is a connector for establishing a USB connection between the multi-function device 1 and a USB device such as a USB memory and a USB cable having a USB terminal. The USB connector 14 is provided to allow the user to insert and remove the USB device in the direction perpendicular to the front panel 11 of the multi-function device 1, i.e., the depth direction of the apparatus (the direction indicated by the arrow P1 in FIG. 1). A number of USB connectors 14 provided in the connector panel 13 may be appropriately designed, and the number of USB connectors 14 is not limited to one.

The printer unit 2 is provided at the lower portion of the multi-function device 1. As shown in FIG. 2, the housing 10 of the printer unit 2 has the door 72 on the front panel 11. The door 72 opens and closes the opening 73 provided at one of side portions (the far right portion in the present example) in the widthwise direction of the front panel 11.

The refill unit 70 is installed in the printer unit 2. The refill unit 70 is, as shown in the drawing, installed at a portion near to the front side of the housing 10 of the printer unit 2, the portion being near to the front panel 11. More specifically, the refill unit 70 is installed inside the opening 73. The door 72 is disposed to be pivotable between a posture (opened posture) in which the refill unit 70 is exposed from the opening 73 by opening the opening 73 by pulling down the door 72 forward, and a posture (closed posture) in which the refill unit 70 is covered and accommodated by closing the opening 73. The door 72 is provided with an axis at a lower end thereof and being pivotably supported by the axis.

Four accommodating chambers 78 are formed to be arranged horizontally in the refill unit 70. Each of the accommodating chambers 78 allows an ink cartridge to be inserted into or removed from the opening 77 provided at the front of the accommodating chambers 78. The opening 77 is opened and closed by doors 76 provided in front of the accommodating chambers 78. Ink cartridges of different colors are inserted into the different accommodating chambers 78 and by closing the doors 76, the ink cartridges are accommodated and retained in the refill unit 70.

Each of the ink cartridges stores one of four color inks, respectively, including black (Bk), yellow (Y), magenta (M), and cyan (C). The color inks stored in the ink cartridges are supplied to a print head 39 (see FIG. 4) through ink tubes 41 (see FIG. 5).

As shown in FIGS. 1 and 2, the opening 4 is formed on the front panel 11 of the housing 10 of the printer unit 2. The opening 4 is provided at a central portion, in the widthwise direction, of the front panel 11 and at a position slightly lower than the center in a height direction of the front panel 11. A lower end of the opening 4 reaches a bottom surface of the multi-function device 1. Inside the opening 4 of the multi-function device 1, the feed tray 20 and the discharge tray 21 are provided.

The feed tray 20 and the discharge tray 21 are arranged such that the discharge tray 21 is stacked above the feed tray 20. Recording sheets as recording medium are accommodated in the feed tray 20. The feed tray 20 accommodates the recording sheets of various sizes not larger than A4 size, such as B5 size and a postcard size. The feed tray 20 is provided with a slide tray (not shown). The slide tray is pulled out where necessary to extend a tray surface of the feed tray 20. Accordingly, recording sheets hating legal-size can be accommodated in the feed tray 20.

As shown in FIG. 3, the feed tray 20 is disposed at a lower portion of the multi-function device 1. The feed tray 20 can be inserted into and removed from the opening 4 in the direction indicated by the arrow P1 shown in FIG. 1 (a left-right direction in FIG. 3).

When the feed tray 20 is inserted into the opening 4 and mounted inside the multi-function device 1, a recording sheet is pulled out in a right direction (sheet feeding direction) in FIG. 3 by a sheet feed roller 25, as will be described later, and conveyed to an image forming unit 24 along a sheet conveying path 23 that is configured to have a substantially U-lettered shape when viewed from a side of the multi-function device 1. The user can supply the recording sheets to the feed tray 20 by drawing out the feed tray 20 from the front side of the multi-function device 1. In the present example, the bottom surface of the feed tray 20 serves as the bottom surface of the multi-function device 1 in a state where the feed tray 20 is inserted into the opening 4.

As shown in FIG. 3, the discharge tray 21 is arranged above the feed tray 20. A recording sheet having an image recorded thereon by the image forming unit 24 is discharged into the discharge tray 21 with a recording surface of the recording sheet being in a horizontal direction. In the present example, the feed tray 20 and the discharge tray 21 are monolithically formed. As shown in FIG. 3, the feed tray 20 and the discharge tray 21 are disposed in the opening 4 with placement surfaces of recording sheets, being kept horizontal. Thus, recording sheets, accommodated in the feed tray 20 and recording sheets, discharged into the discharge tray 21 are retained with recording surfaces thereof being kept horizontal.

Although the feed tray 20 and the discharge tray 21 are monolithically formed in the present example, the feed tray 20 and the discharge tray 21 may be formed by separate members. Instead of employing a configuration in which the feed tray 20 and the discharge tray 21 are removable from the multi-function device 1 as in the present example, each of the feed tray 20 and the discharge tray 21 may be configured in the housing 10 to be unremovable therefrom.

As shown in FIG. 3, a inclined separation plate 22 that is inclined to lean toward a backside of the multi-function device 1 is provided upright on a leading edge side, in an insertion direction, of the feed tray 20. The inclined separation plate 22 separates and guides the recording sheet, which is fed from the feed tray 20, upward. The sheet conveying path 23 is configured above the inclined separation plate 22. The sheet conveying path 23 is configured upward from the inclined separation plate 22 and to turn toward the front side of the multi-function device 1, to extend toward the front side from the backside of the multifunction device 1, to pass through the image forming unit 24, and then to the discharge tray 21. The recording sheet fed from the feed tray 20 is conveyed along the sheet conveying path 23 to perform a U-turn upward toward the image forming unit 24. The recording sheet being formed with an image by the image forming unit 24 is further conveyed and discharged to the discharge tray 21.

Figure 4:
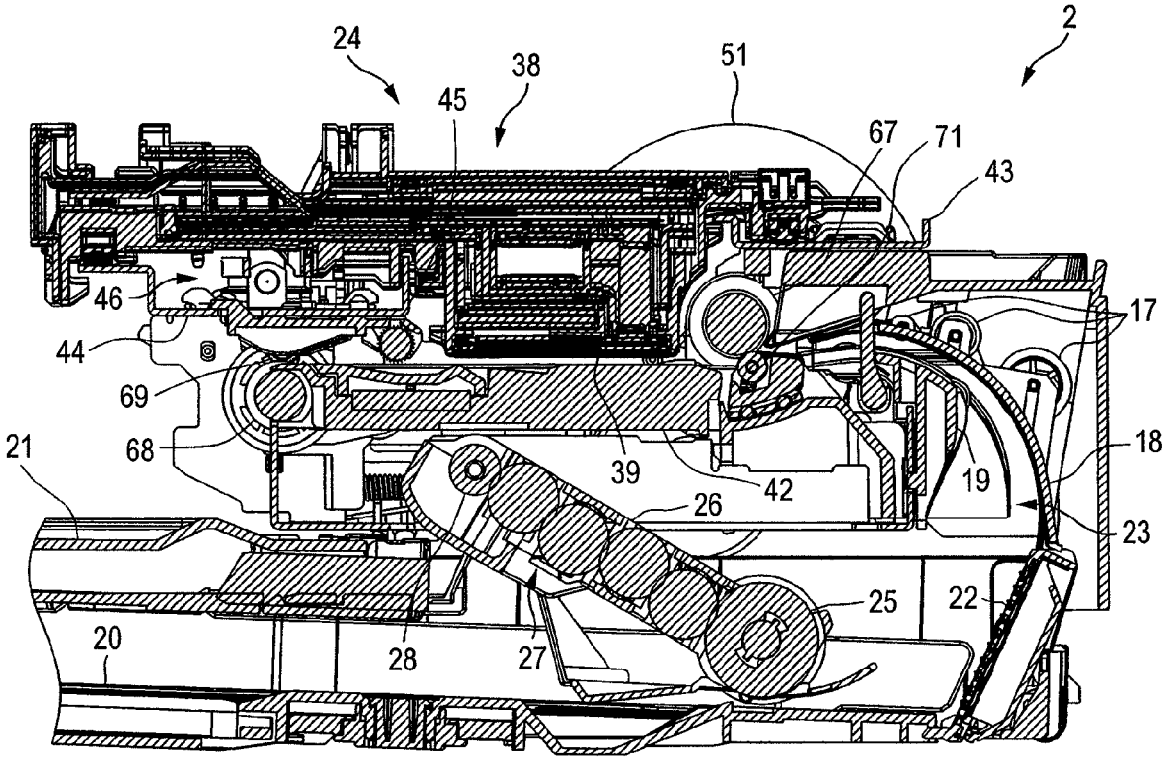
FIG. 4 is a partial enlarged cross-sectional view showing a main configuration of a printer unit.

FIG. 4 is an enlarged partial cross-sectional view showing a main configuration of the printer unit 2. As shown in FIG. 4, the sheet feed roller 25 is provided above the feed tray 20. The sheet feed roller 25 pressure contacts recording sheets stacked on the feed tray 20 to feed the topmost one of the recording sheets toward the inclined separation plate 22. The sheet feed roller 25 is rotatably supported at a leading end of a sheet feeding arm 26. The sheet feed roller 25 is rotated by a torque supplied by a motor, which is not shown, and transmitted by a torque transmission mechanism 27 having a plurality of gears engaging with one another.

The sheet feeding arm 26 swings up and down with respect to the feed tray 20 while a base shaft 28 serving as a pivotal axis. As shown in FIG. 4, the sheet feeding arm 26 swings downward by its own weight to allow the sheet feed roller 25 to be contactable with the teed tray 20. When the feed tray 20 and the discharge tray 21 are inserted into or removed from the opening 4, the sheet feeding arm 26 is retracted upward. When the sheet feed roller 25 is rotated while being in pressure contact with a recording sheet on the feed tray 20, by a frictional force between a roller surface of the sheet feed roller 25 and the recording sheet, the topmost recording sheet is fed toward the inclined separation plate 22. The recording sheet thus fed is guided upward to the sheet conveying path 23 by a leading edge of the recording sheet abutting against the inclined separation plate 22.

When the topmost recording sheet is fed by the sheet feed roller 25, a recording sheet immediately beneath the topmost recording sheet may be fed together toward the inclined separation plate 22 by the action of friction or static electricity. However, the recording sheet immediately beneath is prevented from being fed upward to the sheet conveying path 23 by abutting against the inclined separation plate 22.

The sheet conveying path 23 is configured by an outer guide surface and an inner guide surface which face each other with a predetermined interval therebetween, except at a portion where the image forming unit 24 is arranged. For example, a portion of the sheet conveying path 23 that is located at the backside of the multi-function device 1 is configured by an outer guide member 18 and an inner guide member 19 that are fixed in the frame. The outer guide member 1 is provided with a plurality of conveying rollers 17. A roller surface of the conveying rollers 17 is exposed from a guide surface of the outer guide member 18. The conveying roller 17 is rotatably supported by the outer guide member 18 such that an axis of the conveying rollers 17 is configured to be in parallel with a widthwise direction of the sheet conveying path 23. The conveying rollers 17 allow the recording sheet to be conveyed smoothly at a position where the sheet conveying path 23 curves in a U-shaped manner.

As shown in FIG. 4, the image forming unit 24 is provided on the sheet conveying path 23. The image forming unit 24 includes a carriage 38 that is provided with the print head 39 and reciprocating in a main scanning direction (a direction parallel to the widthwise direction of the multi-function device 1). Color inks, including black (Bk), yellow (Y), magenta (M), and cyan (C), are supplied through the ink tubes 41 (see FIG. 5) to the print head 39 from the ink cartridges in the refill unit 70 (see FIG. 2) provided at the rightmost side of the front panel 11 in the multi-function device 1. Then, the print head 39 selectively ejects the inks as ultra-small ink drops. By ink drops being selectively ejected from the print head 39 during reciprocation of the carriage 38, an image forming is performed on the recording sheet conveyed on a platen 42.

Figure 5:
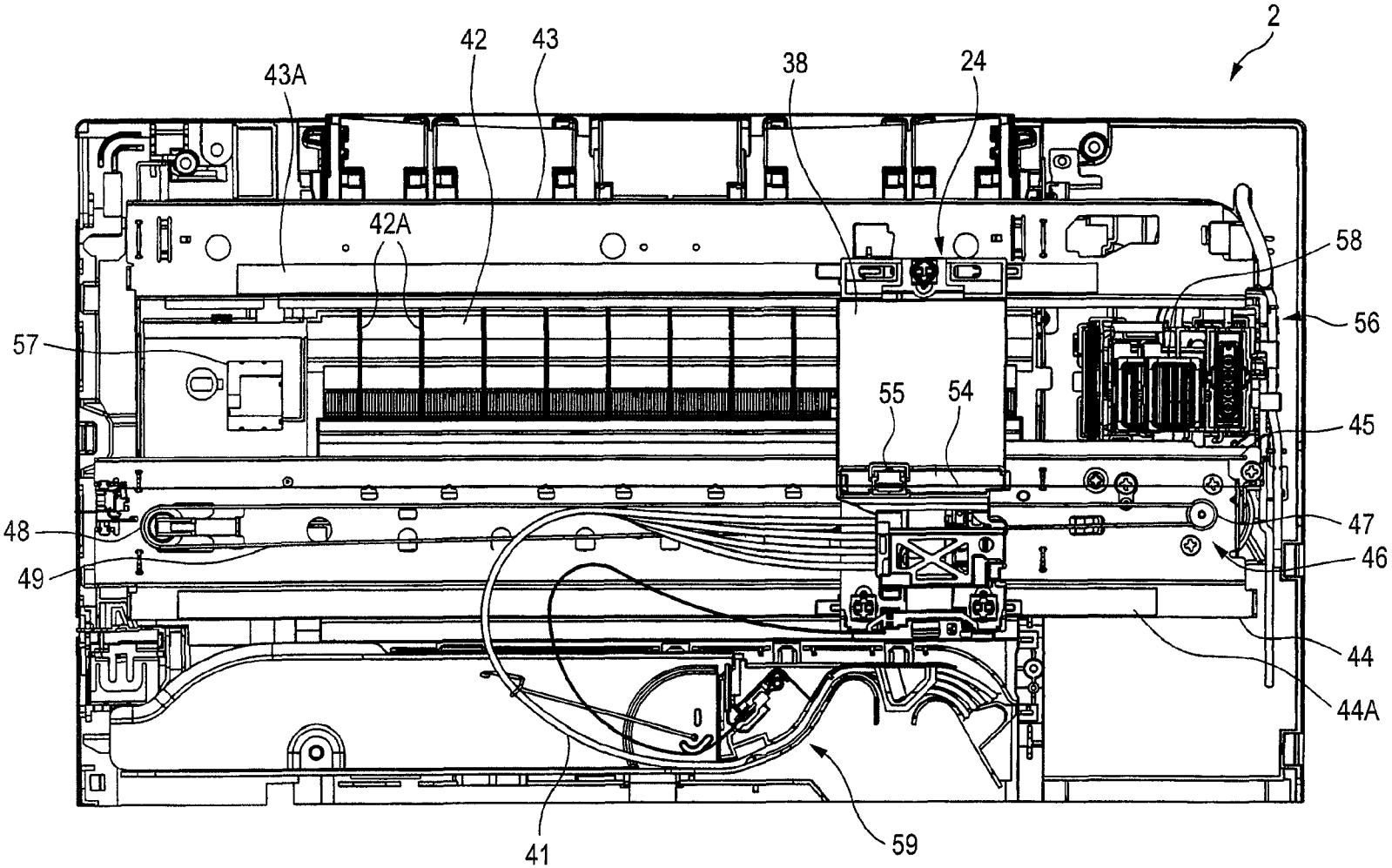
FIG. 5 is a partial enlarged cross-sectional view showing the main configuration of the printer unit.

FIG. 5 is a plan view showing a main configuration of the printer unit 2. As shown in FIG. 5, a pair of guide rails 43 and 44 is provided on the upper side of the sheet conveying path 23 with a predetermined interval therebetween in a conveying direction (an up-down direction in FIG. 5) of the recording sheets, to extend in a direction (a left-right direction in FIG. 5) orthogonal to the conveying direction of the recording sheets. The carriage 38 is placed across the guide rails 43 and 44 to be reciprocable in a horizontal direction orthogonal to the conveying direction of the recording sheets. The guide rail 43 arranged on the upstream side in the conveying direction of the recording sheets has a flat shape such that a length of the guide rail 43 in the widthwise direction of the sheet conveying path 23 is longer than a reciprocating range of the carriage 38. A top surface of the guide rail 43 on the downstream side in the conveying direction is a guide surface 43A. The guide surface 43A slidably supports an end of the carriage 38 on the upstream side.

The guide rail 44 arranged on the downstream side in the conveying direction of the recording sheets has a flat shape such that a length of the guide rail 44 in the widthwise direction of the sheet conveying path 23 is substantially the same as that of the guide rail 43. In the guide rail 44, an end 45 on the upstream side is bent upward at a substantially right angle. A top surface of the guide rail 44 on the downstream side in the conveying direction is a guide surface 44A. The guide surface 44A slidably supports an end of the carriage 38 on the downstream side. The carriage 38 nips the edge 45 with rollers, which are not shown, or the like. Accordingly, the carriage 38 is slidably supported on the guide surfaces 43A and 44A of the guide rails 43 and 44 and reciprocates relative to the edge 45 of the guide rail 44 in the horizontal direction orthogonal to the conveying direction of the recording sheets.

A belt drive mechanism 46 is provided along the guide rail 44 on the top surface of the guide rail 44. The belt drive mechanism 46 is such that an endless ring-shaped timing belt 49 having teeth provided on an inner side thereof is stretched between a drive pulley 47 and a follower pulley 48 which are respectively provided near both ends, in the widthwise direction of the sheet conveying path 23, of the belt drive mechanism 46. Due to the timing belt 49 being coupled to the carriage 38, the carriage 38 reciprocates in accordance with an operation of the belt drive mechanism 46.

The drive pulley 47 is rotatably provided at one end (a right end in FIG. 5) of the top surface of the guide rail 44 with a direction orthogonal to the guide surface 44A of the guide rail 44 as an axis. That is, the axis of the drive pulley 47 is in a vertical direction. Although not shown in FIG. 5, a motor is provided below the guide rail 44. Due to a torque that is applied to the axis of the drive pulley 47 from the motor, the drive pulley 47 is rotated.

The timing belt 49 is stretched between the drive pulley 47 and the follower pulley 48. Although not shown in FIG. 5, spur teeth that engage with the inner teeth of the timing belt 49 are formed on an outer circumference of the drive pulley 47. Accordingly, rotation of the drive pulley 47 is reliably transmitted to the timing belt 49 and thereby the timing belt 49 performs a circular motion. Note that although in the present example the endless (looped) timing belt 49 is used, a timing belt having ends (non-looped timing belt) may be used instead. In such a case, both of the ends of the timing belt are coupled to the carriage 38.

The carriage 38 is coupled to the timing belt 49. When the timing belt 49 performs a circular motion, the carriage 38 reciprocates relative to the edge 45 on the guide rails 43 and 44. The print head 39 is installed on the carriage 38, whereby the print head 39 reciprocates in the widthwise direction of the sheet conveying path 23 as the main scanning direction.

An encoder strip 54 of a linear encoder (not shown) is arranged along the edge 45 of the guide rail 44. The linear encoder detects the encoder strip 54 by a photo-interrupter 55 installed on the carriage 38. The reciprocation of the carriage 38 is controlled based on a detection signal of the linear encoder.

As shown in FIG. 5, the platen 42 is arranged on the lower side of the sheet conveying path 23 to face the print head 39. The platen 42 is composed of a plurality of ribs 42A placed vertically and upwardly from a bottom surface of the platen 42. The ribs 42A are a thin-width plate-like member extending in the conveying direction of recording sheets (the up-down direction in FIG. 5). The plurality of ribs 42A are provided in the widthwise direction of the apparatus with a predetermined interval therebetween. A recording sheet is supported on the top of the plurality of ribs 42A thus provided. The platen 42 is arranged at a central portion of the reciprocating range of the carriage 38, through which a recording sheet passes. The width of the platen 42 is sufficiently greater than the maximum width of the conveyable recording sheets. Both edges of a recording sheet always pass above the platen 42.

Maintenance units such as a purge mechanism 56 and a waste ink tray 57 are arranged in an area where a recording sheet does not pass through, i.e., an area other than an area where image recording is performed by the print head 39. The purge mechanism 56 suctions and removes air bubbles or foreign matter from a nozzle (not shown) of the print head 39. The purge mechanism 56 is provided with a cap 58 that covers the nozzle of the print head 39, a pump mechanism connected to the print head 39 via the cap 58, and a movement mechanism for allowing the cap 58 to contact the nozzle of the print head 39. Note that in FIG. 5, the pump mechanism and the movement mechanism are located below the guide rails 43 and 44 and the cap 58 and thus are not shown in FIG. 5. When air bubbles or the like of the print head 39 are suctioned and removed, the carriage 38 is moved such that the print head 39 is located on the cap 58. Under such a state, the cap 58 is moved upward and thereby makes intimate contact to hermetically seal the nozzle underneath the print head 39 and ink is sucked from the nozzle of the print head 39 by a pump coupled to the cap 58.

The waste ink tray 57 receives idle ejection of ink from the print head 39, called flushing. The waste ink tray 57 is integrally provided with the platen 42 in an area within the reciprocating range of the carriage 38 and outside the image recording area. Due to the maintenance units, maintenance such as removing air bubbles or mixed color ink within the print head 39 is performed.

Inks are supplied to the print head 39 through the ink tubes 41 coupled to ink cartridges (not shown) held in the refill unit 70 (see FIG. 2). The ink cartridges are provided for different ink colors, respectively, and different color inks are supplied to the print head 39 by the ink tubes 41 independently provided for each color. Each of the ink tubes 41 are a synthetic resin tube and have flexibility to bend according to the reciprocation of the carriage 38.

The ink tubes 41 coupled to the respective ink cartridges are pulled out to approximately the center of the apparatus along the widthwise direction of the apparatus and fixed to a fixing clip 59 of an apparatus frame. Note that in FIG. 5, the ink tubes 41 extending outward toward the ink cartridge side from the fixing clip 59 are omitted. The ink tubes 41 are not fixed to the frame at portions between the fixing clip 59 and the carriage 38, and its posture changes along with the reciprocation of the carriage 38. Specifically, along with the movement of the carriage 38 to one end in a reciprocating direction (left side in FIG. 5), each of the ink tubes 41 moves in the moving direction of the carriage 38 while being bent such that the bending radius of a U-shaped curve portion becomes smaller. On the other hand, along with the movement of the carriage 38 to the other end in the reciprocating direction (right side in FIG. 5), each ink tube 41 moves in the moving direction of the carriage 38 while being bent such that the bending radius of the curve portion becomes larger.

As shown in FIG. 4, a conveying roller 67 is provided on the upstream side of the image forming unit 24. A pinch roller 71 is provided at a position facing the conveying roller 67. The pinch roller 71 is urged by an urging member, such as a coil spring, to be contactable with the conveying roller 67. When a recording sheet enters between the conveying roller 67 and the pinch roller 71, the pinch roller 71 is retracted by an amount equal to the thickness of the recording sheet and nips the recording sheet with the conveying roller 67. Accordingly, a torque of the conveying roller 67 is reliably transmitted to the recording sheet. Then, the recording sheet is conveyed onto the platen 42.

A sheet discharge roller 68 is provided on the downstream side of the image forming unit 24. A spur roller 69 is provided at a position facing the sheet discharge roller 68. The spur roller 69 is in contact with the sheet discharge roller 68. The recording sheet on which an image is formed is nipped and conveyed by the sheet discharge roller 68 and the spur roller 69. The spur roller 69 is also urged to be contactable with the sheet discharge roller 68, as with the pinch roller. However, since the spur roller 69 contacts a recorded recording sheet, a roller surface is made rough in a spur-like fashion so that an image recorded on the recording sheet is not degraded.

The conveying roller 67 and the sheet discharge roller 68 are intermittently driven at a predetermined linefeed width by a drive force being transmitted to the conveying roller 67 and the sheet discharge roller 68 from a motor which is not shown. Rotation of the conveying roller 67 is synchronized with rotation of the sheet discharge roller 68. A rotary encoder (not shown) provided to the conveying roller 67 detects, by a photo-interrupter, an encoder disk 51 that rotates with the conveying roller 67, whereby the rotation of each of the conveying roller 67 and the sheet discharge roller 68 is controlled.

A top portion of the multi-function device 1 is configured as the scanner unit 3. Referring to FIGS. 6-11, a schematic configuration of the scanner unit 3 will be described below.

Figure 6:
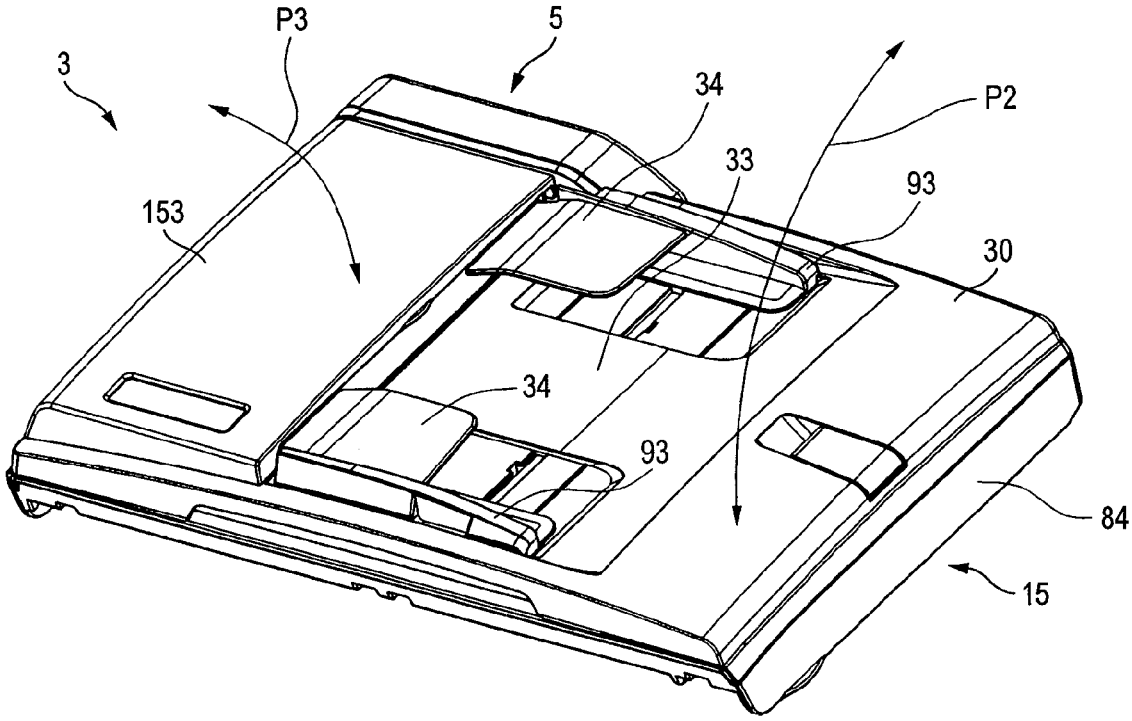
FIG. 6 is a perspective view showing an external configuration of a scanner unit.
Figure 7:
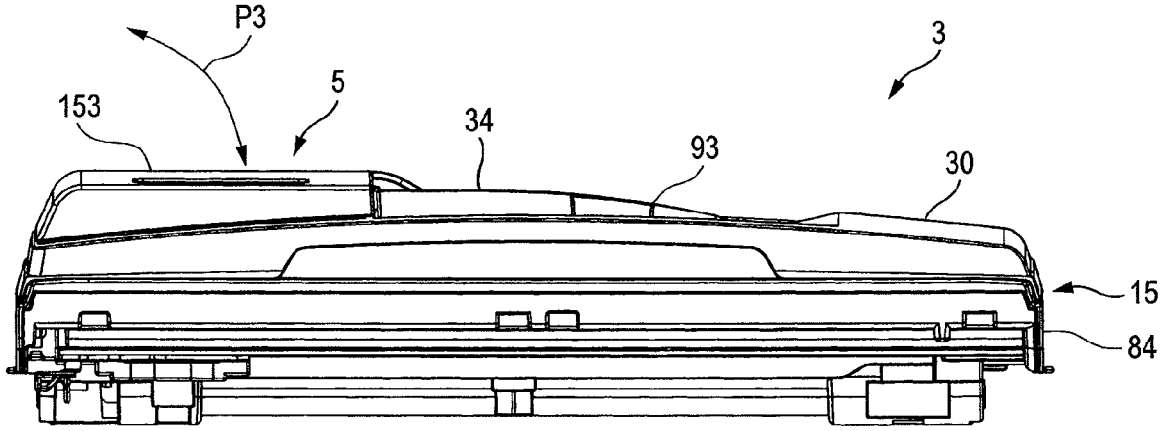
FIG. 7 is a front view of the scanner unit.
Figure 8:
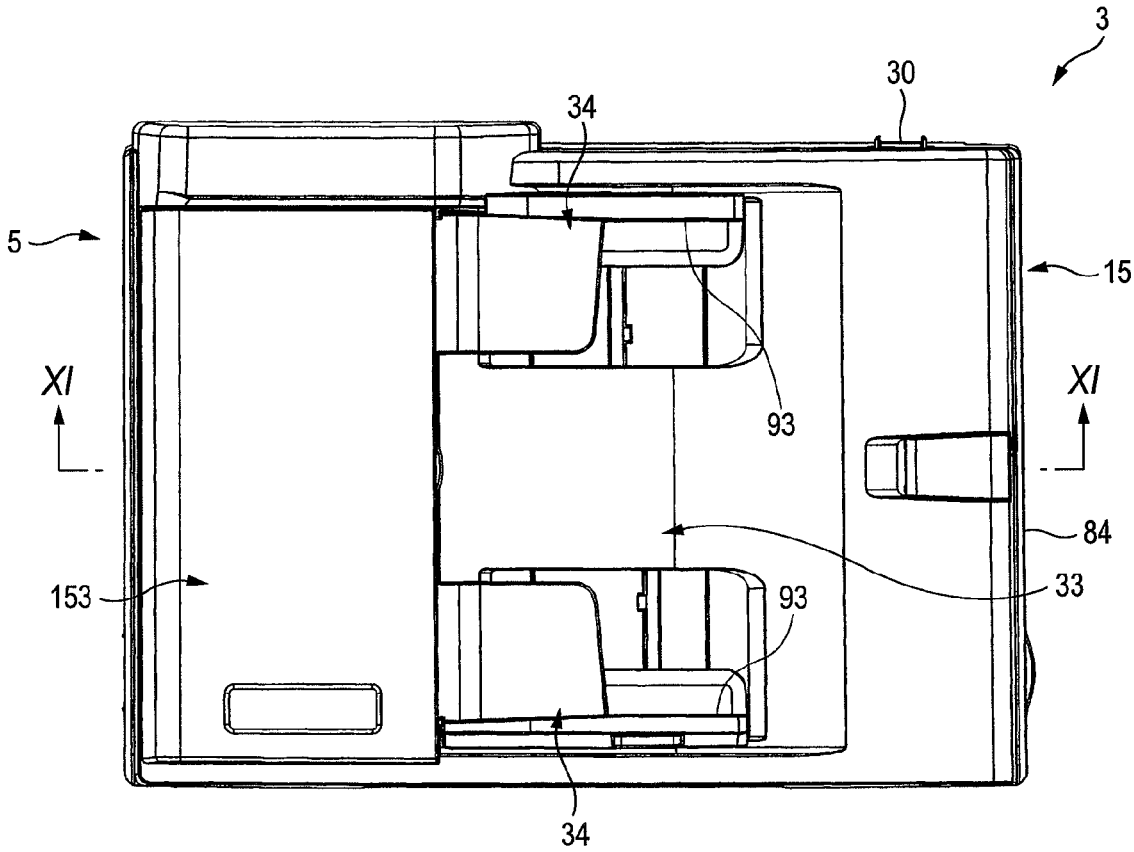
FIG. 8 is a plan view of the scanner unit.
Figure 9:
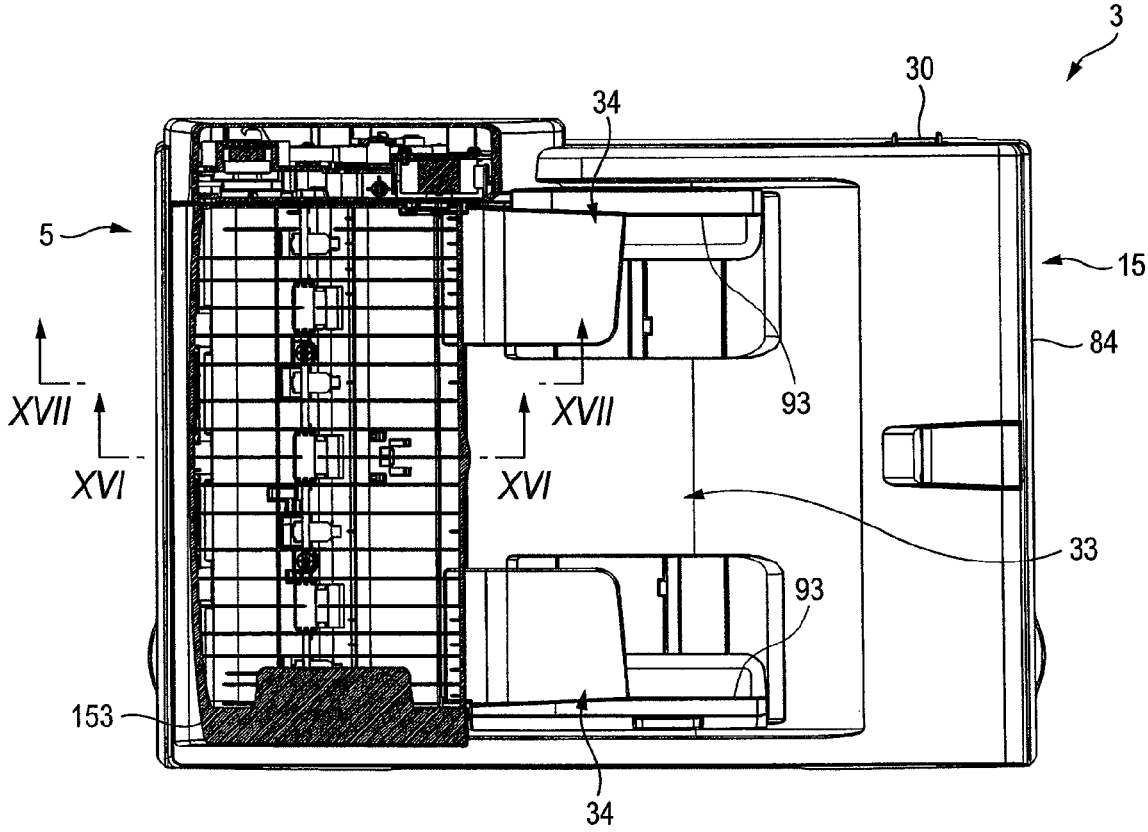
FIG. 9 is a plan view of the scanner unit showing a state in which part of an internal configuration of the ADF is perspectively shown.

The scanner unit 3 is configured such that a cover 30 is mounted on a scanning platform 15 that serves as an FBS (Flatbed Scanner), via a hinge on the backside to be freely openable and closable in a direction indicated by an arrow P2 in FIG. 6. The cover 30 is provided with the ADF 5 and thus the ADF 5 is also opened and closed along with the opening/closing of the cover 30.

A platen glass 80 (FIG. 11) is disposed on a top surface of the scanning platform 15. As shown in FIG. 6, when the cover 30 is closed over the scanning platform 15, the platen glass 80 is covered by the cover 30. A pressing member 82 is provided below the cover 30, i.e., a surface facing the platen glass 80. The pressing member 82 presses a sheet (document) to be scanned placed on the platen glass 80 and is composed of a sponge, a plate member, and the like. The pressing member 82 has a single color, such as white, over the entire area to obtain stable reflected light from the sheet to be scanned.

An opening 31 (see FIG. 13) is provided at one end of the underside of the cover 30. The opening 31 is communicated with a sheet conveying path 151, as will be described later. The opening 31 is used, when an image on the sheet is scanned using the ADF 5, to temporarily expose the sheet to a scanning area 80A of the platen glass 80 from the sheet conveying path 151.

The platen glass 80 is a transparent plate made of glass or acrylic resin. A positioning member 83 that partitions between the scanning area 80A used when scanning an image on the sheet using the ADF 5 and a scanning area 80B used when the scanner unit 3 is used as an FBS is provided at a leftmost portion of the platen glass 80. The positioning member 83 serves as a positioning reference used when the sheets to be scanned are placed on the platen glass 80. Marks indicating placement positions according to the size of the sheet, such as A4 size and B5 size, are marked on a top surface of the positioning member 83. When the ADF 5 is used, the positioning member 83 serves as a guide that guides to return the sheet passed above the scanning area 80A to the sheet conveying path 151 (see FIG. 13) provided in the ADF 5.

Figure 10:
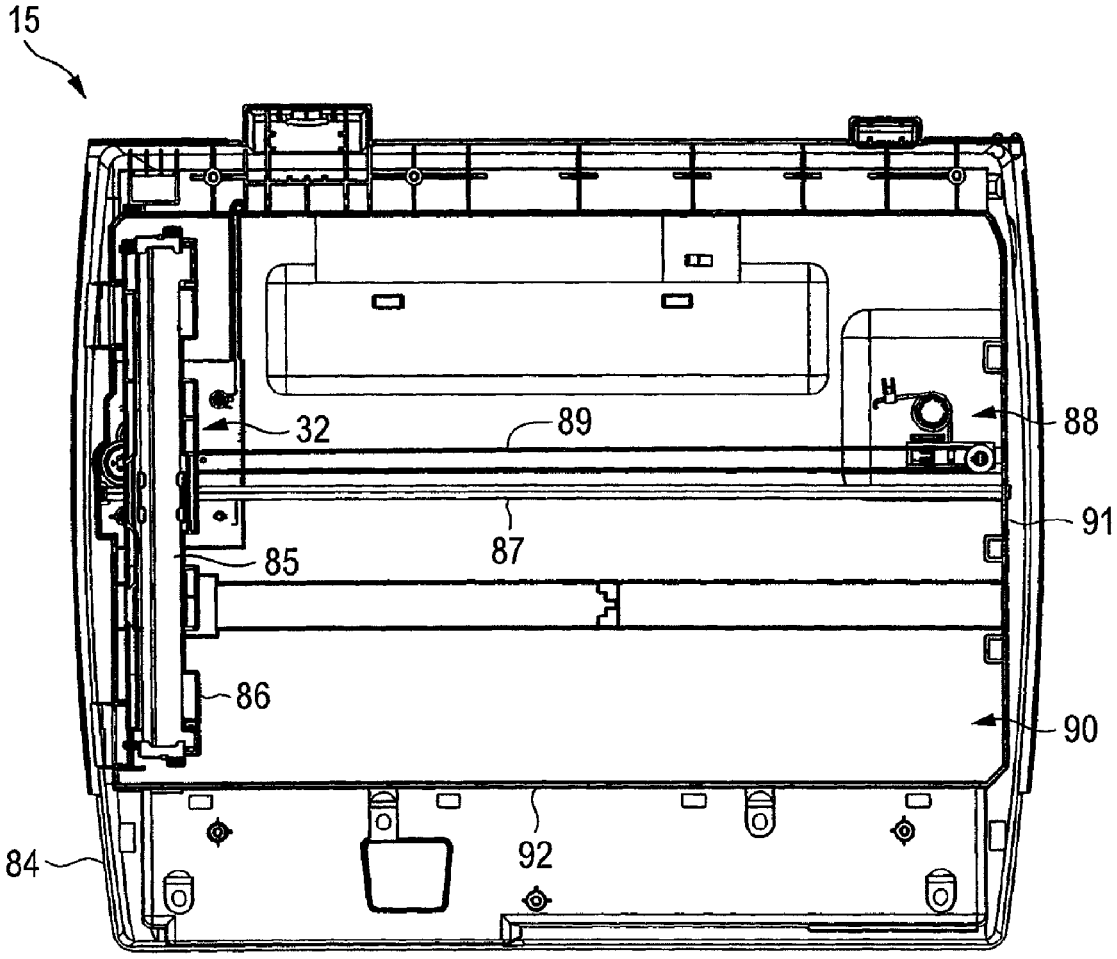
FIG. 10 is a plan view showing a main configuration of the scanner unit.
Figure 11:
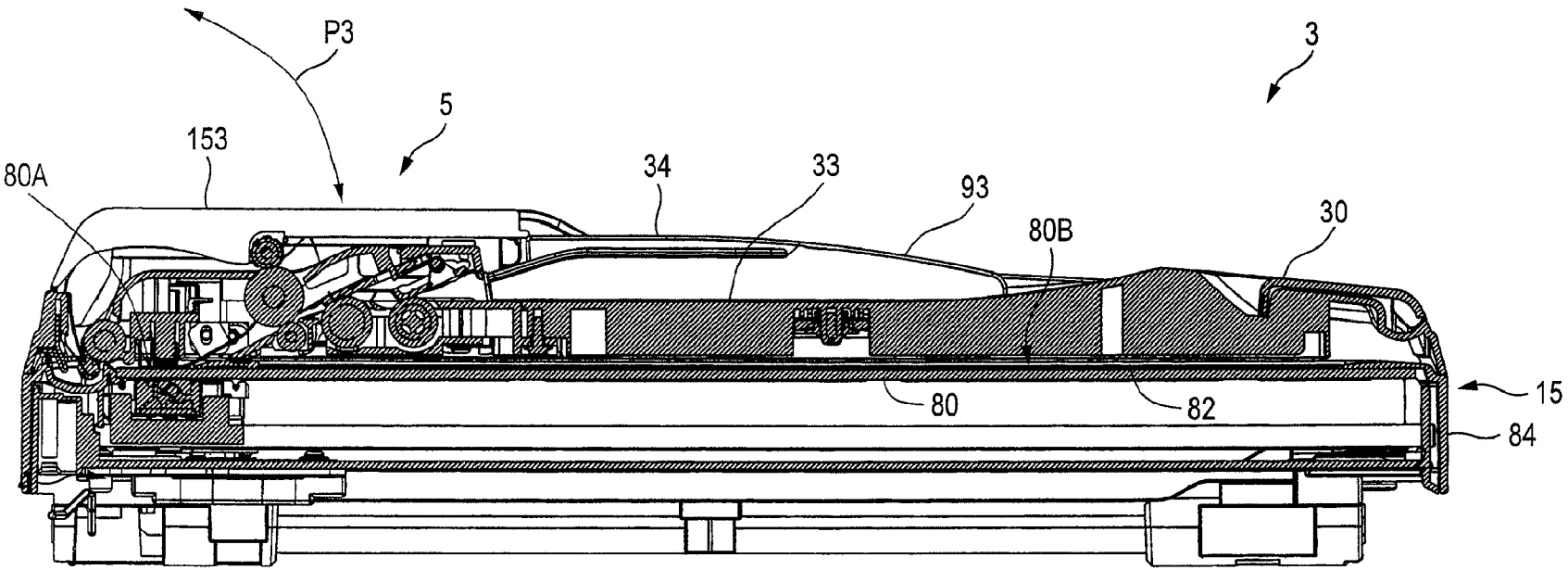
FIG. 11 is a vertical cross-sectional view showing a cross section taken along a line XI-XI shown in FIG. 8.

As shown in FIG. 10, the scanning platform 15 is provided with an image scanning unit 32. When the scanner unit 3 is used as an FBS, the cover 30 is opened and the sheet (document) is placed on the platen glass 80. Then, the cover 30 is closed and the sheet is fixed onto the platen glass 80. The image on the sheet is scanned by the image scanning unit 32 performs scanning while moving along the platen glass 80.

The scanning platform 15 has a thin box shaped casing 84. The image scanning unit 32 is disposed in the inner space of the casing 84 to be reciprocable in a horizontal direction. The casing 84 is made of a synthetic resin. The casing 84 has a base portion 90 including a bottom plate, a sidewall 91 rising from a periphery of the base portion 90, and a partition plate 92, which are monolithically formed. The partition plate 92 partitions between a region where the image scanning unit 32 is arranged and a region where a board of the operation panel 6 are arranged. The casing 84 is formed with various parts such as support ribs for supporting the platen glass 80, a boss portion for screwing various members, and through-holes for electrical wiring. The parts formed on the casing 84 may be appropriately designed according to the employment and design of the scanning platform 15, and thus a detailed description thereof will be omitted.

The image scanning unit 32 is provided with a contact image sensor (hereinafter, referred to as the "CIS") 85 which is an example of an image scanning element, and an elongated box-shaped carriage 86. The CIS 85 is installed in the carriage 86 to be supported from below. The CIS 85 faces a bottom surface of the platen glass 80. The CIS 85 is a so-called intimate-contact-type line image sensor that allows a light source such as an LED to emit light to irradiate the light on the sheet, guides light reflected from the sheet to a photoelectric conversion element by a lens, and outputs, by the photoelectric conversion element, an electrical signal according to the intensity of the reflected light. The CIS 85 is installed on the carriage 86 and reciprocates below the platen glass 80.

As shown in FIG. 10, a guide shaft 87 is disposed over a widthwise direction of the casing 84 (a left-right direction in FIG. 10). The carriage 86 is fitted in the guide shaft 87, and the image scanning unit 32 is supported to be smoothly movable below the platen glass 80 in a direction (the left-right direction in FIG. 10) orthogonal to a longitudinal direction of the carriage 86. A belt drive mechanism 88 is provided along the guide shaft 87. As with the above-described belt drive mechanism 46, the belt drive mechanism 88 includes a timing belt 89 installed between pulleys. The carriage 86 is fixed to the timing belt 89 of the belt drive mechanism 88 and reciprocates by a circular motion of the timing belt 89. Accordingly, when the scanner unit 3 is used as an FBS, the CIS 85 scans an image on the sheet placed on the platen glass 80 while the carriage 86 is moved along the bottom surface of the platen glass 80.

As shown in FIGS. 6-9, on the cover 30 at the top of the scanner unit 3, a feed tray (supply sheet retaining portion) 33 and a discharge tray (discharged sheet retaining portion) 34 are arranged such that the discharge tray 34 is stacked above the feed tray 33. In the feed tray 33, a pair of sheet guides 93 is provided in a depth direction of the multi-function device 1 with a space therebetween, to be slidably movable in the depth direction. The sheet guides 93 rise from the feed tray 33 and regulate the position, in a widthwise direction of the sheet placed on the feed tray 33.

The sheet guides 93 is provided with a known coupling mechanism such as a rack and a pinion so that when one of the sheet guides 93 is slid and moved, the other of the sheet guide 93 is also slid and moved in conjunction with the opposing sheet guide 93 in a contrary direction. When the sheet width is small, by sliding and moving one of the sheet guides 93 positioned on the front side of the multi-function device 1 to the backside, the other of the sheet guides 93 positioned on the backside is slid and moved toward the front side in conjunction with the opposing sheet guide 93. According to this configuration, the sheet width to be regulated by the pair of sheet guides 93 can be narrowed with substantially the center in the depth direction as the center.

In contrast, when the sheet width is wide, by sliding and moving one of the sheet guides 93 positioned on the front side of the multi-function device 1 to the front side, the other of the sheet guides 93 positioned on the backside is slid and moved toward the backside in conjunction with the one sheet guide 93, whereby the sheet width to be regulated by the pair of sheet guides 93 can be widened.

The discharge tray 34 is monolithically formed with the pair of sheet guides 93 with a gap provided therebetween in an upward direction of the feed tray 33. Specifically, the discharge tray 34 is provided as canopy-like flat plates provided to extend from the tops of the sheet guides 93 to the inner side. The discharge tray 34 is arranged at a position lower than a top surface of an upper flat portion 179 (see FIGS. 13 and 14) constituting a lower discharge guide of a discharge chute portion 158, as will be described later. Thus, although a trailing edge of the sheet discharged to the discharge tray 34 remains in the discharge chute portion 158, a leading edge side is supported by the discharge tray 34 arranged at a position lower than the upper flat portion 179. Hence, the load applied to the leading edge side of the sheet increases and the load applied to the trailing edge side decreases, and thus, the trailing edge is easily lifted up.

The sheet discharged from the ADF 5 is supported on the discharge tray 34 at its both sides and held to be separated from the sheet on the feed tray 33. Since the length, in a sheet discharge direction, of the discharge tray 34 is shorter than the length of the sheet, a leading edge side, in the sheet discharge direction, of the sheet is held on the feed tray 33 to hang from the discharge tray 34. Thus, a leading edge portion, in the sheet discharge direction, of the sheet on the discharge tray 34 overlaps the trailing edge portion, in a sheet feeding direction, of the sheet on the feed tray 33. However, since the leading edge portion, in the sheet feeding direction, of the sheet on the feed tray 33 and the trailing edge portion, in the sheet discharge direction, of the sheet on the discharge tray 34 are held in two tiers above and below the discharge tray 34, the sheets are not mixed. By shortening the discharge tray 34, space necessary on the cover 30 is reduced, the multi-function device 1 may be made to be thinner and smaller.

Sheets are placed on the feed tray 33 with their faces to be scanned facing down. A plurality of sheets (a stack of sheets) placed on the feed tray 33 are fed one by one in order from a bottommost sheet of the stack and conveyed by the ADF 5. The sheets fed are continuously conveyed, by the ADF 5, from the feed tray 33, via a feed chute portion 154, the sheet conveying path 151, and the discharge chute portion 158, to the discharge tray 34 disposed above the feed tray 33. In the sheet conveying process, the sheet is conveyed onto the scanning area 80A and an image on the sheet is scanned by the image scanning unit 32 disposed below the scanning area 80A. Details of the ADF 5 will be described later.

Figure 12:
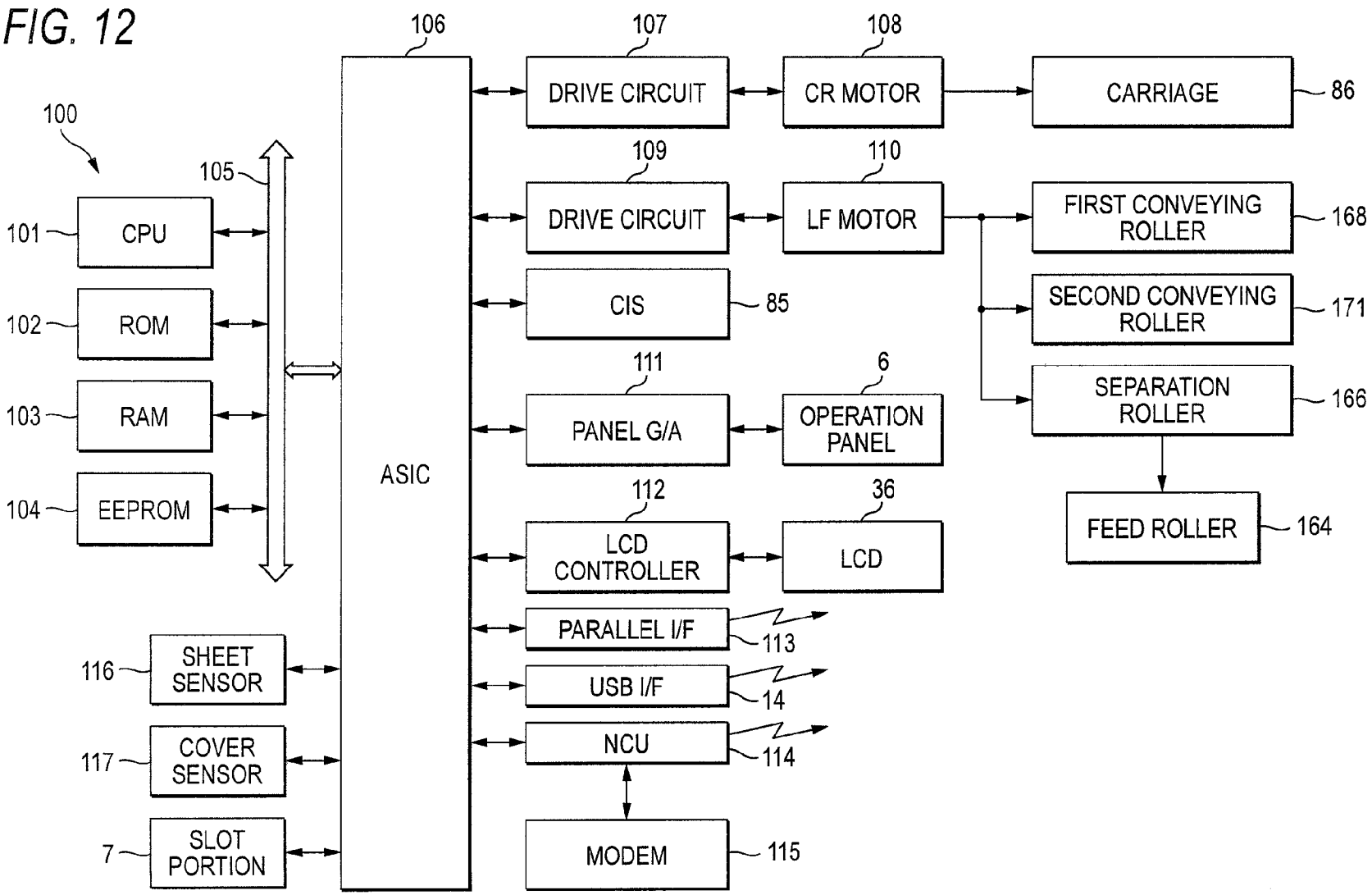
FIG. 12 is a block diagram showing a configuration of a control unit and peripheral devices provided in the multi-function device.

FIG. 12 shows a configuration of a control unit 100 of the multi-function device 1 and peripheral devices connected to the control unit 100. The control unit 100 performs overall control of the whole operation of the multi-function device 1 including the scanner unit 3 and the printer unit 2. However, in the description of the present example, components of the printer unit 2 are omitted in FIG. 12. As shown in FIG. 12, the control unit 100 is provided with a microcomputer that includes a CPU (Central Processing Unit) 101, a ROM (Read Only Memory) 102, a RAM (Random Access Memory) 103, and an EEPROM (Electrically Erasable and Programmable ROM) 104. The control unit 100 is connected to an ASIC (Application Specific Integrated Circuit) 106 via a bus 105.

The ROM 102 stores therein a program for controlling various operations of the multi-function device 1. The EEPROM 104 stores therein various data to be used for processing to be performed according to the program. The RAM 103 is used as a storage area where various data to be used when the CPU 101 executes the program is temporarily stored, or as a data or program expansion area.

The CPU 101 performs overall control of devices provided in the control unit 100 or controlled devices that is to be controlled by the control unit 100. The CPU 101 reads, a program stored in the ROM 102 or data stored in the RAM 103 or the EEPROM 104 and performs computation according to the program.

The ASIC 106 generates, according to an instruction from the CPU 101, a phase excitation signals that are applied to each of a carriage motor (CR motor) 108 of the scanner unit 3 and a conveying motor (LF motor) 110 of the ADF 5, and provides the signal to drive circuits 107 and 109 of the carriage motor 108 and the conveying motor 110. The ASIC 106 generates a drive signal to be applied to the carriage motor 108 and the conveying motor 110 via the drive circuits 107 and 109, and controls the rotation of the carriage motor 108 and the conveying motor 110.

The drive circuit 107 drives the carriage motor 108 connected to the carriage 86 of the scanner unit 3. The drive circuit 107 receives the signal output from the ASIC 106 and generates an electrical signal for rotating the carriage motor 108. The carriage motor 108 having received the electrical signal is rotated and a torque of the carriage motor 108 is transmitted to the carriage 86 via a scanning mechanism, whereby the carriage 86 is scanned (moved back and forth).

The drive circuit 109 drives the conveying motor 110 connected to a separation roller 166, a first conveying roller 168 (which serves as a drive roller), and a second conveying roller 171 of the ADF 5. The drive circuit 109 receives the signal output from the ASIC 106 and generates an electrical signal for rotating the conveying motor 110. The conveying motor 110 having received the electrical signal is rotated and a torque of the conveying motor 110 is transmitted to the separation roller 166, the first conveying roller 168, and the second conveying roller 171 via a drive mechanism that is provided with gears and a drive shaft. The torque is transmitted to a feed roller 164 from the separation roller 166 via a torque transmission mechanism.

The CIS 85 that scans an image on the sheet in the scanner unit 3 is connected to the ASIC 106. The ASIC 106 provides, based on an instruction from the CPU 101, an electrical signal for irradiating light from a light source and a timing signal for outputting image data from a photoelectric conversion element, to the CIS 85. The CIS 85 receives these signals and thereby irradiates light on the sheet at predetermined timing and outputs image data converted by the photoelectric conversion element.

A panel gate array (panel G/A) 111 that controls the operation buttons 35 from which a desired instruction is inputted to the multi-function device 1 is connected to the ASIC 106. The panel gate array 111 detects any of the operation buttons 35 of the operation panel 6 that is pressed by the user and outputs a predetermined code signal. Each of the operation buttons 35 is associated with unique key codes, respectively. When the CPU 101 receives a key code indicated by the code signal from the panel gate array 111, the CPU 101 performs a control process that should be performed, according to a predetermined key processing table. The key processing table is a table in which the key codes are associated with control processes, and stored in the ROM 102.

An LCD controller 112 that controls screen display of the liquid crystal display (LCD) 36 is connected to the ASIC 106. The LCD controller 112 allows the liquid crystal display 36 to display information on an operation of the printer unit 2 or the scanner unit 3 on a screen, based on an instruction from the CPU 101.

The slot portion 7 into which various small memory cards are inserted, and a parallel interface 113 and the USB connector 14 that perform data transmission and reception with a computer via a parallel cable or a USB cable are connected to the ASIC 106. Furthermore, an NCU (Network Control Unit) 114 and a MODEM 115 for implementing a facsimile function are connected to the ASIC 106.

A sheet sensor 116 for detecting a sheet in the sheet conveying path 151 (see FIG. 13) in the ADS and a cover sensor 117 for detecting opening and closing of an ADS cover 153 (which serves as a cover member) are connected to the ASIC 106.

With reference to FIGS. 13-22, the configuration and operation of the ADF 5 will be described in detail below.

Figure 13:
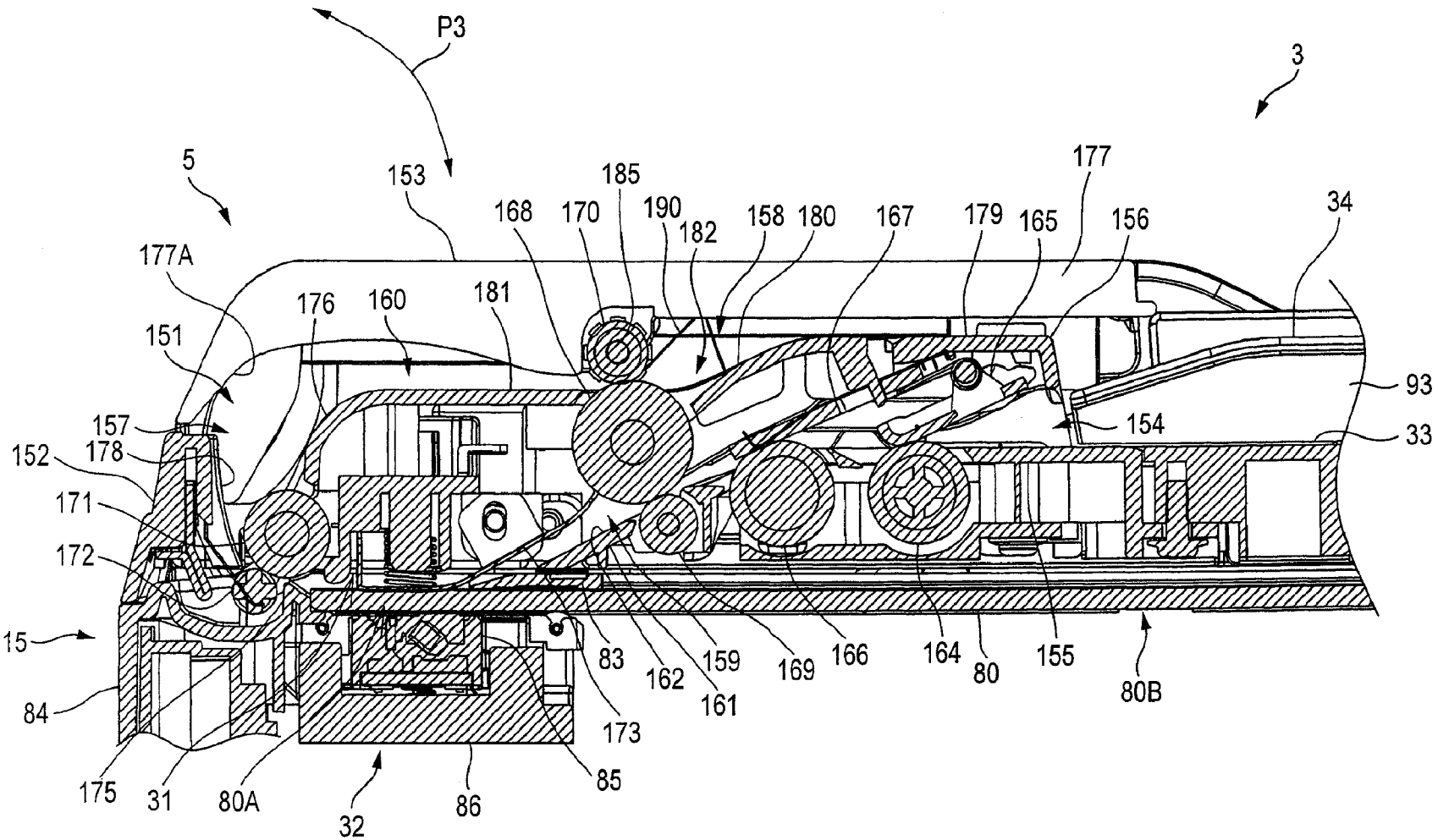
FIG. 13 is a cross-sectional view showing the internal configuration of the ADF.

As shown in FIG. 13, a housing of the ADF 5 is configured by an ADF main body 152 (which serves as an apparatus main body) formed monolithically with the cover 30, and the ADS cover 153 provided to be pivotable relative to the ADF main body 152. The ADF cover 153 forms a top surface of the housing of the ADF 5. The ADF cover 153 pivots relative to the ADF main body 152 about a pivot shaft, which is not shown, provided at one side (left side in FIG. 13) of the ADF main body 152, in a direction indicated by an arrow P3 in FIG. 13. When the ADF cover 153 is opened, inner components of the ADF 5 are exposed. A pivot free end of the ADF cover 153 extends to cover the entire area of a partition plate 156, as will be described later.

The guide ribs 177 are protrudingly provided on an inner side of the ADS cover 153. The plurality of guide ribs 177 are formed in a widthwise direction of the sheet conveying path 151 with a predetermined interval therebetween. The guide ribs 177 form outer guide surfaces of a curving path 157 and an upper sheet conveying path 160 of the sheet conveying path 151, and the discharge chute portion 158.

Figure 14:
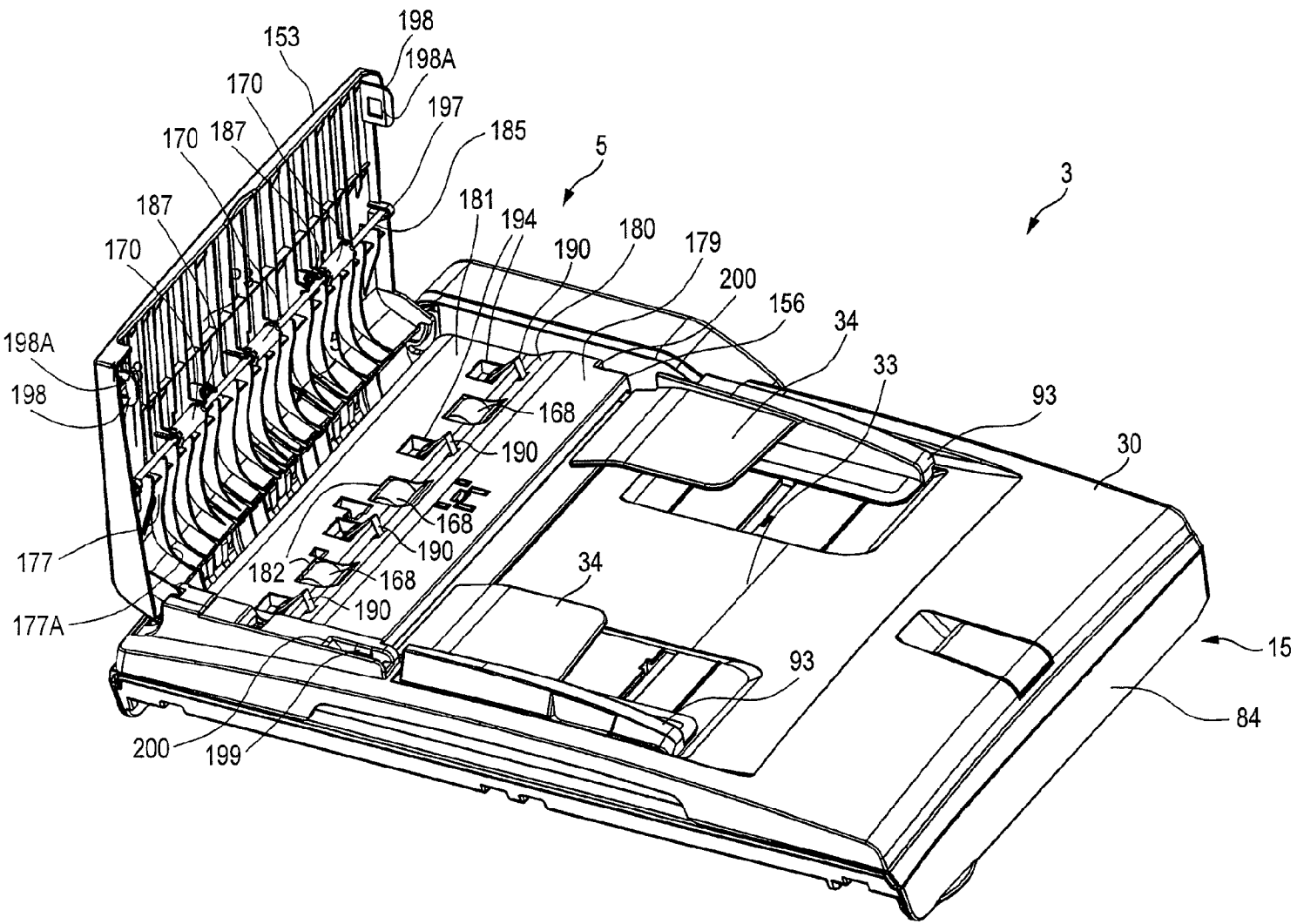
FIG. 14 is a perspective view of the scanner unit showing an open state of a discharge chute portion.

The posture of the ADF cover 153 changes between a closed posture shown in FIG. 6 and an opened posture shown in FIG. 14, by pivoting the ADF cover 153 relative to the ADF main body 152. When using the ADF 5, the ADF cover 153 is brought into a closed posture. The ADF cover 153 is locked to the ADF main body 152 to maintain the closed posture. Specifically, as shown in FIG. 14, locking pieces 198 are formed at both ends, in the widthwise direction, of the pivot free end of the ADF cover 153. When the ADF cover 153 is closed over the ADF main body 152, the locking pieces 198 enter slots 200 formed in the ADF main body 152, whereby the ADF cover 153 is locked to the ADF main body 152.

Figure 15:
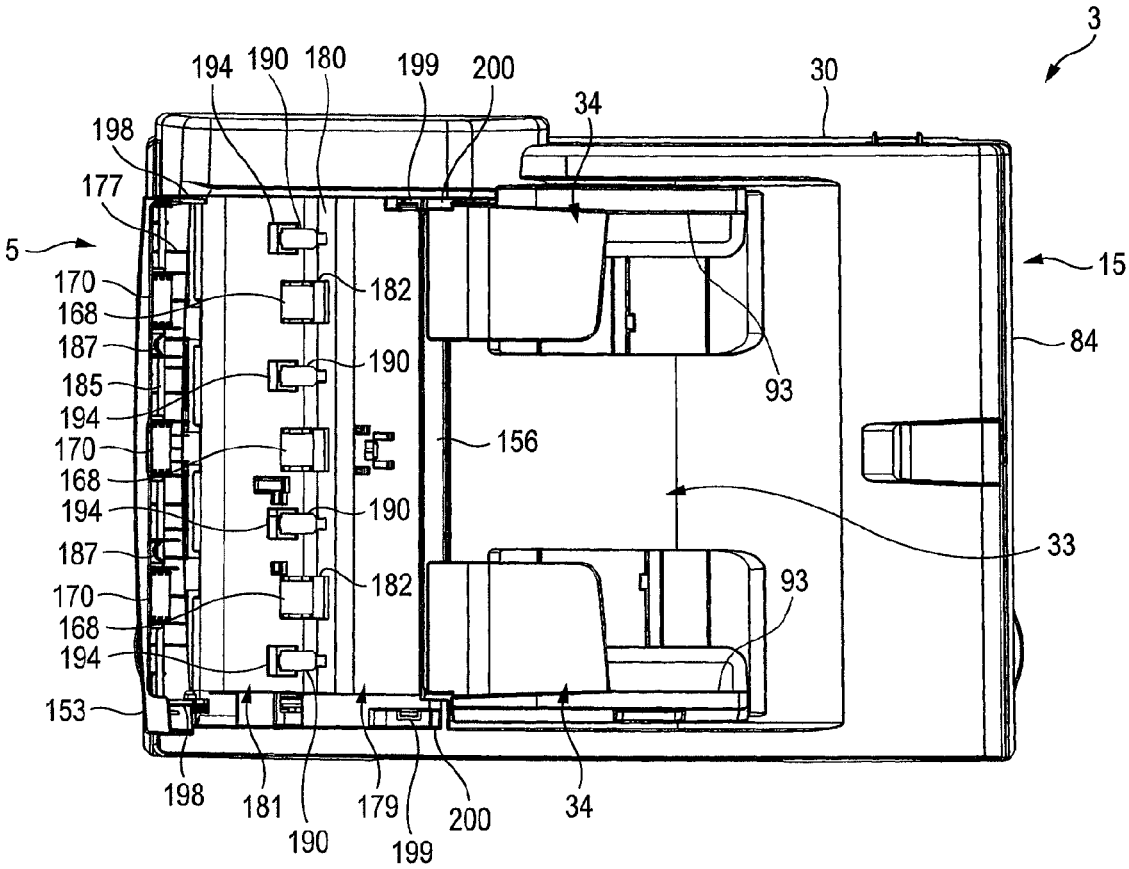
FIG. 15 is a plan view of the scanner unit showing an open state of the discharge chute portion.

For a locking mechanism of the ADF cover 153, as shown in FIG. 14 and FIG. 15, hook 199 is provided to each slot 200 and when the locking pieces 198 enter the slots 200, the hooks 199 fit in slots 198A (see FIG. 14) of the locking pieces 198. As a matter of course, it is also possible to use other known locking mechanisms such as a lock lever. Due to the locking mechanism being disengaged and thereby the ADF cover 153 being brought into an opened posture, the guide ribs 177 also pivot with the ADF cover 153, whereby the curving path 157 and the upper sheet conveying path 160 of the sheet conveying path 151 and the discharge chute portion 158 are opened.

The sheet conveying path 151 that couples the feed tray 33 to the discharge tray 34 is formed inside the ADF 5. The sheet conveying path 151 is configured to have a substantially U-lettered shape when viewed from the front side of the multi-function device 1. The sheet conveying path 151 is divided into a lower sheet conveying path 159, the curving path 157, and the upper sheet conveying path 160. The sheet conveying path 151 is configured by the ADF main body 152 and the guide ribs 177 formed on the ADF cover 153.

The feed chute portion 154 is formed to continue to the sheet conveying path 151 from the feed tray 33. The feed chute portion 154 of the ADF 5 is formed to extend from the feed tray 33. The feed chute portion 154 is configured as a passage with a predetermined width defined in a vertical direction, by a guide plate 155 integrally formed with the ADF main body 152 and the partition plate 156 arranged on the inner side of the ADF cover 153 as guide surfaces. The sheet that is to be scanned is placed on the feed tray 33 with its face to be scanned facing down, such that a leading edge, in a sheet feeding direction, of the sheet is inserted in the feed chute portion 154.

A sheet feeding mechanism having a plurality of rollers is provided in the feed chute portion 154. Specifically, the sheet supply unit includes the feed roller 164, a feed nip piece 165 that pressure contacts the feed roller 164, the separation roller 166, and a separation nip piece 167 that pressure contacts the separation roller 166. Note that the configuration of the rollers and the nip pieces is merely an example and it is, as a matter of course, possible to change it to other known mechanisms, by changing the number or disposition of the rollers or using a pinch roller instead of each nip piece.

The feed roller 164 is rotatably provided near a center in a sheet widthwise direction of the feed chute portion 154 such that part of a roller surface of the feed roller 164 is exposed from atop surface of the guide plate 155. The separation roller 166 is rotatably provided at a position spaced from the feed roller 164 toward the downstream side in a sheet feeding direction of the sheets, such that part of a roller surface of the separation roller 166 is exposed from the top surface of the guide plate 155. The feed roller 164 and the separation roller 166 are driven to rotate by a torque being transmitted thereto from the conveying motor 110 (see FIG. 12).

The feed nip piece 165 is provided at a position where the partition plate 156 faces the feed roller 164, to be movable up and down in a direction in which the feed nip piece 165 contacts the feed roller 164. The feed nip piece 165 is a pad-like piece with a width slightly narrower than a roller width, in an axial direction, of the feed roller 164 and contacts the roller surface of the feed roller 164. The feed nip piece 165 is elastically urged downward by an urging member, which is not shown, and contacts the feed roller 164 while not nipping the sheet.

The separation nip piece 167 is provided at a position where the partition plate 156 faces the separation roller 166, to be movable up and down in a direction in which the separation nip piece 167 contacts the separation roller 166. The separation nip piece 167 is a pad-like piece with a width slightly narrower than a roller width, in an axial direction, of the separation roller 166 and contacts the roller surface of the separation roller 166. The separation nip piece 167 is elastically urged downward by a spring member which is not shown, and contacts the roller surface of the separation roller 166 while not nipping the sheet.

As shown in FIG. 13, the sheet conveying path 151 has the lower sheet conveying path 159, the curving path 157, and the upper sheet conveying path 160. The sheet conveying path 151 is configured to have a substantially U-lettered shape that continues from the feed chute portion 154 to the discharge chute portion 158 via the lower sheet conveying path 159, the curving path 157, and the upper sheet conveying path 160.

Figure 16:
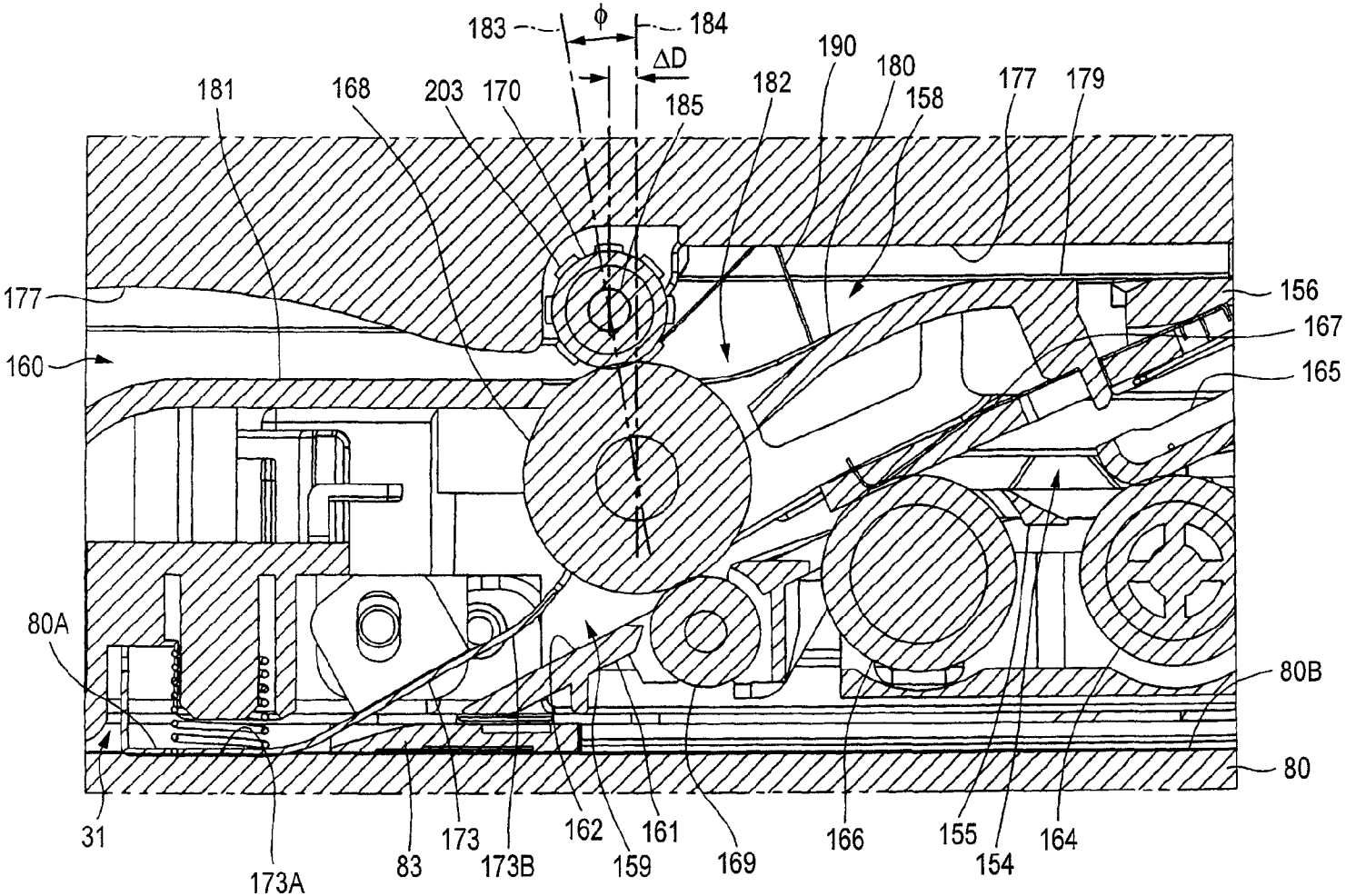
FIG. 16 is an enlarged cross-sectional view of a main portion showing a cross section taken along a line XVI-XVI shown in FIG. 9.

The lower sheet conveying path 159 of the sheet conveying path 151 is continuously formed, as a passage with a predetermined vertical dimension, by a guide end 161 on the downstream side in a conveying direction of the guide plate 155 and a sheet guide 173 that presses the sheet exposed to the scanning area BOA from the opening 31. As shown in FIG. 16, the guide end 161 has a slope 162 inclined gently downwardly from near an exit of the feed chute portion 154 toward the downstream side in the conveying direction. The slope 162 continues to the opening 31.

The sheet guide 173 has a horizontal portion 173A having a horizontal surface facing the scanning area 80A and a sloped portion 173B continuing from the horizontal portion 173A to the upstream side in the conveying direction. The sloped portion 173B is provided to extend along the slope 162 of the guide end 161 and has a sloping surface facing the slope 162. A passage with a predetermined vertical dimension is formed by the sloped portion 173B and the slope 162. The passage serves as the lower sheet conveying path 159. As such, since the lower sheet conveying path 159 is gently inclined and formed to the opening 31, the sheet conveyed from the feed chute portion 154 is smoothly guided to the opening 31 without being strongly bent.

As shown in FIGS. 13 and 16, a pinch roller 169 is arranged in the lower sheet conveying path 159. The pinch roller 169 is arranged such that its axial direction matches a widthwise direction (a direction perpendicular to the paper in FIG. 13) of the lower sheet conveying path 159. The pinch roller 169 is rotatably provided such that part of a roller surface of the pinch roller 169 is exposed to the lower sheet conveying path 159 from the slope 162 of the guide end 161.

The first conveying roller 168 is arranged at a position facing the pinch roller 169 with the lower sheet conveying path 159 being interposed therebetween. The first conveying roller 168 is also arranged such that its axial direction matches the widthwise direction (the direction perpendicular to the paper in FIG. 13) of the lower sheet conveying path 159. The first conveying roller 168 is rotatably supported on the ADF main body 152 and part of a roller surface of the first conveying roller 168 is exposed to the lower sheet conveying path 159.

The pinch roller 169 is supported to be urged to the side of the first conveying roller 168 by an elastic member such as a coil spring, which is not shown. In the lower sheet conveying path 159, the roller surface of the pinch roller 169 is in pressure contact with the roller surface of the first conveying roller 168. The first conveying roller 168 is coupled to the conveying motor 110 (see FIG. 12) via a torque transmission mechanism, which is not shown, and driven to rotate by a torque transmitted from the conveying motor 110. The pinch roller 169 also rotates according to the rotation of the first conveying roller 168. The pinch roller 169 conveys the sheet to the lower sheet conveying path 159 from the feed chute portion 154 pressure contacts the first conveying roller 168. The torque of the first conveying roller 168 is transmitted to the sheet, whereby the sheet is conveyed.

The first conveying roller 168 is formed to have an outer diameter sufficiently larger than the outer diameter of the pinch roller 169. Thus, a contact surface between the first conveying roller 168 and the sheet increases and accordingly the torque of the first conveying roller 168 is reliably transmitted to the sheet, to thereby prevent an occurrence of a slip of the sheet.

The sheet conveyed through the lower sheet conveying path 159 is exposed to the scanning area 80A from the opening 31 with its face to be scanned facing down. At this time, an image on the face of the sheet is scanned by the image scanning unit 32 provided below the scanning area 80A. The sheet being scanned is returned to the curving path 157 of the ADF 5 such that a leading edge of the sheet is guided upward by a scoop-up member 175 provided at an end of the platen glass 80.

The curving path 157 of the sheet conveying path 151 is formed such that the curving path 157 starts near the opening 31, bent upward and then curves to greatly bend toward the rear (a right direction in FIG. 13) and then continues to the upper sheet conveying path 160. As shown in FIG. 13, at an end of the partition plate 156 on the side of the curving path 157, a curve end 176 curving to trail down along the Curving path 157 is formed continuously from the partition plate 156. The curving path 157 is defined by the curve end 176 as an inner conveying guide surface and a curve portion 177A of the guide ribs 177 (which serves as an upper conveying guide) formed on the backside of the ADF cover 153 and guide ribs 178 integrally formed with the ADF main body 152 as an outer conveying guide surface.

The second conveying roller 171 and a pinch roller 172 that contacts the second conveying roller 171 are arranged at a portion most upstream in the conveying direction of the curving path 157. The second conveying roller 171 is arranged on an inner side of the curving path 157 and the pinch roller 172 is arranged on an outer side of the curving path 157. Part of a roller surface of each of the second conveying roller 171 and the pinch roller 172 is exposed to the curving path 157.

The pinch roller 172 is, as with the pinch roller 169, supported to be urged toward the second conveying roller 171 by an elastic member such as a coil spring, which is not shown. Accordingly, in the curving path 157, the roller surface of the pinch roller 172 contacts the roller surface of the second conveying roller 171. As with the first conveying roller 168, the second conveying roller 171 is also coupled to the conveying motor 110 (see FIG. 12) via a torque transmission mechanism, which is not shown, and driven to rotate by a torque transmitted from the conveying motor 110. The pinch roller 169 rotates in accordance with the second conveying roller 171. According to the pinch roller 172, the sheet contacts the second conveying roller 171 and the torque of the second conveying roller 171 is transmitted to the sheet. Accordingly, the sheet is conveyed through the curving path 157 and sent to the upper sheet conveying path 160 on the downstream side.

The upper sheet conveying path 160 of the sheet conveying path 151 is formed continuously from the curving path 157. The upper sheet conveying path 160 is configured as a passage with a predetermined dimension provided in a vertical direction, using the guide ribs 177 (corresponding to an upper conveying guide in the present invention) formed on the backside of the ADF cover 153 and a lower flat portion 181 of the partition plate 156 as a pair of conveying guide surfaces. The lower flat portion 181 has a top surface horizontally extending toward the downstream in the conveying direction from the curving path 157. The lower flat portion 181 defines a part of the partition plate 156 continuing to the curve end 176. As shown in FIGS. 13 and 16, the upper sheet conveying path 160 is formed in a substantially straight manner and guides the sheet conveyed from the curving path 157 to the downstream side in the conveying direction with the sheet being kept horizontal.

As shown in FIGS. 13-16 and 18, a through-hole 182, which penetrates through the partition plate 156, is provided in a leading end portion of the upper sheet conveying path 160, i.e., a portion of the partition plate 156 corresponding to a position most downstream in the conveying direction of the sheet conveying path 151. As shown in the drawings, a part of a topside of the first conveying roller 168 is exposed to the upper sheet conveying path 160 via the through-hole 182.

The pinch roller 170 is arranged at the terminal of the upper sheet conveying path 160. The pinch roller 170 is arranged such that its axial direction matches a widthwise direction (a direction perpendicular to the paper in FIG. 13) of the upper sheet conveying path 160. The pinch roller 170 is formed to have an outer diameter sufficiently smaller than the outer diameter of the first conveying roller 168. The pinch roller 170 is rotatably supported by the guide ribs 177 formed on the backside of the ADF cover 153. The support structure of the pinch roller 170 will be described later. The pinch roller 170 is rotatably supported on the guide ribs 177 with a rotary shaft 185 of the pinch roller 170 being elastically urged. Thus, in a state in which the ADF cover 153 is closed over the ADF main body 152, the roller surface of the pinch roller 170 contacts the roller surface of the first conveying roller 168 exposed from the through-hole 182.

Since the first conveying roller 168 is driven to rotate by a torque transmitted from the conveying motor 110 (see FIG. 12), the pinch roller 170 contacts the first conveying roller 168 and rotates in accordance with the rotation of the first conveying roller 168. The first conveying roller 168 and the pinch roller 170 serve as a pair of discharge rollers.

In the present example, as shown in FIG. 16, the first conveying roller 168 and the pinch roller 170 are arranged such that a direction in which the first conveying roller 168 contacts the pinch roller 170, i.e., a direction (hereinafter, referred to as a "line segment direction") 183 indicated by a line segment connecting a shaft center of the first conveying roller 168 and a shaft center of the pinch roller 170, as viewed in a cross section, is inclined at an angle $\phi$ toward upstream in the conveying direction with respect to a normal direction 184 to the lower flat portion 181 at the end of the upper sheet conveying path 160.

That is, a pair of discharge rollers (conveying roller 168 and the pinch roller 170) is arranged such that a direction in which the drive roller (conveying roller 168) contacts the follower roller (pinch roller 170) is inclined at an angle $\phi$ toward upstream in the conveying direction with respect to a direction of a normal line (normal direction 184) of the guide surface of the sheet conveying path 160 at a position the most downstream in the conveying direction.

Note that the angle ϕ is appropriately set to an optimal value, which is determined by the outer diameters of the first conveying roller 168 and the pinch roller 170, and the shape of the sheet conveying path.

As described above, the upper sheet conveying path 160 is configured as a flat linear sheet conveying path. Thus, in the present example, as a means of inclining the line segment direction 183 toward upstream in the conveying direction with respect to the normal direction 184, a means of arranging the pinch roller 170 at a position shifted by a distance AD to the upstream side in the conveying direction from a position vertically above the first conveying roller 168 is adopted. Since the first conveying roller 168 and the pinch roller 170 are thus arranged, the sheet discharged by the rollers 168 and 170 is conveyed upward at the angle ϕ or an angle corresponding to the distance ΔD.

The configuration in which the first conveying roller 168 and the pinch roller 170 are arranged, as in the present example, is particularly effective when the sheet is discharged in the following manner. Specifically, the sheet discharged from the first conveying roller 168 and the pinch roller 170 may be prevented from advancing by a preceding discharged sheet (preceding sheet) and be stopped immediately. In such a case, the trailing edge of the preceding sheet remains near the nip position; however, when the stacking amount of sheets discharged to the discharge chute portion 158 or the discharge tray 34 is small, the trailing edge of the preceding sheet is scraped upward by the pinch roller 170, and thus, a problem that a subsequent sheet rises above the preceding sheet is not likely to occur.

Figure 25:
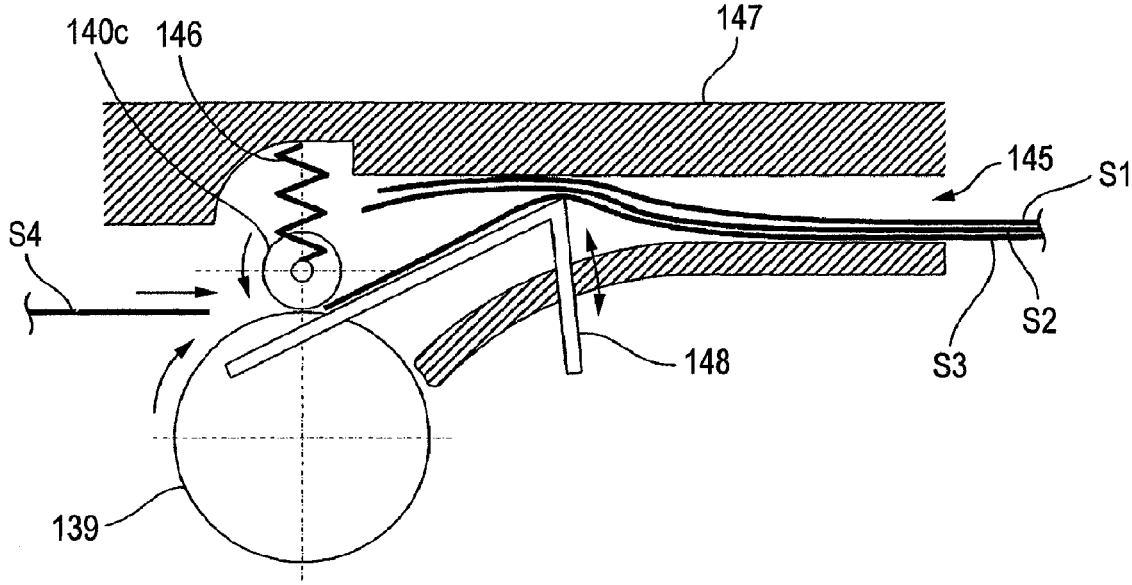
FIG. 25 is a diagram for describing a conveyance of a sheet in the conventional ADF.

However, when the stacking amount of sheets discharged to the discharge chute portion 158 or the discharge tray 34 is large or when the roller surface of the pinch roller 170 is changed to be slippery due to its aged deterioration, the trailing edge of a preceding sheet may not be scraped upward, as described earlier by referring to FIG. 25. Even in such a case, since in the present example the rollers are arranged such that the line segment direction 183 is inclined more toward the upstream side in the conveying direction than the normal direction 184, the trailing edge of a preceding sheet is easily scraped upward by the pinch roller 170. Thus, a subsequent sheet is not discharged above a preceding sheet.

In the present example, as shown in FIGS. 14 and 15, a plurality of first conveying rollers 168 and a plurality of pinch rollers 170 are arranged in a widthwise direction of the sheet conveying path 151 with a predetermined interval therebetween. Specifically, three first conveying rollers 168 and three pinch rollers 170 are arranged at the center in the widthwise direction and at both ends. The first conveying rollers 168 and the pinch rollers 170 on both sides in the widthwise direction are disposed to support a maximum size sheet that is conveyable through the sheet conveying path 151. For example, when the maximum size of a conveyable sheet is A4-size, the rollers are disposed at positions where both edges of the sheet can be nipped. Since a plurality of rollers are thus disposed, the sheet is conveyed using a uniform force over the entire area in the widthwise direction of the sheet. Though not shown in the drawings, a plurality of pinch rollers 169 which contact the corresponding first conveying rollers 168 below the first conveying rollers 168, a plurality of second conveying rollers 171, and a plurality of pinch rollers 172 may be arranged in the widthwise direction of the sheet conveying path 151. Note that the arrangement position of each roller and the number of rollers to be disposed are not limited to the above-described positions and numbers. They can be appropriately changed according to the configuration of the multifunction device 1 such as the maximum size of the conveyable sheet, and the shape of the sheet conveying path.

The discharge chute portion 158 is formed continuously from the leading end of the upper sheet conveying path 160. The discharge chute portion 158 is configured as a passage with a predetermined dimension defined in a vertical direction by an upper guide surface including the guide ribs 177 (which serves as an upper discharge guide) formed on the backside of the ADF cover 153 and a lower guide surface including a sloped portion 180 and the upper flat portion 179 of the partition plate 156 (which serves as a lower discharge guide, see FIG. 14). When the sheet is discharged to the discharge chute portion 158, the sheet is guided to the discharge tray 34 by the upper and lower guide surfaces of the discharge chute portion 158.

The sloped portion 180 of the partition plate 156 is formed continuously from the lower flat portion 181 and includes part of the partition plate 156. The sloped portion 180 continues to the upper flat portion 179 located at a higher position on the downstream side in the conveying direction than the lower flat portion 181. The upper flat portion 179 also includes part of the partition plate 156 and has a top surface horizontally extending toward the downstream in the conveying direction from the sloped portion 180. In the present example, the upper flat portion 179 is set at a position higher than the nip position between the first conveying rollers 168 and the pinch rollers 170.

Since the discharge chute portion 158 is thus formed, the sheet discharged to the discharge chute portion 158 is smoothly guided to the upper flat portion 179 along the sloped portion 180. When a plurality of sheets are discharged, even if trailing edges of the sheets are not elastically supported by the spring pieces 190, as will be described later, the sheets climb up on the upper flat portion 179 disposed at a position higher than a nip position H (a nip height, see FIG. 17) between the first conveying rollers 168 and the pinch rollers 170 and the trailing edges of the sheets are supported extending to the sloped portion 180, and thus, the trailing edges of the sheets are easily lifted up. Accordingly, a subsequent sheet is easily placed beneath a preceding sheet and the stacking order of sheets is kept to be the original ascending order. Note that the top surface of the upper flat portion 179 disposed in the above-described manner serves as an upper guide surface.

Figure 17:
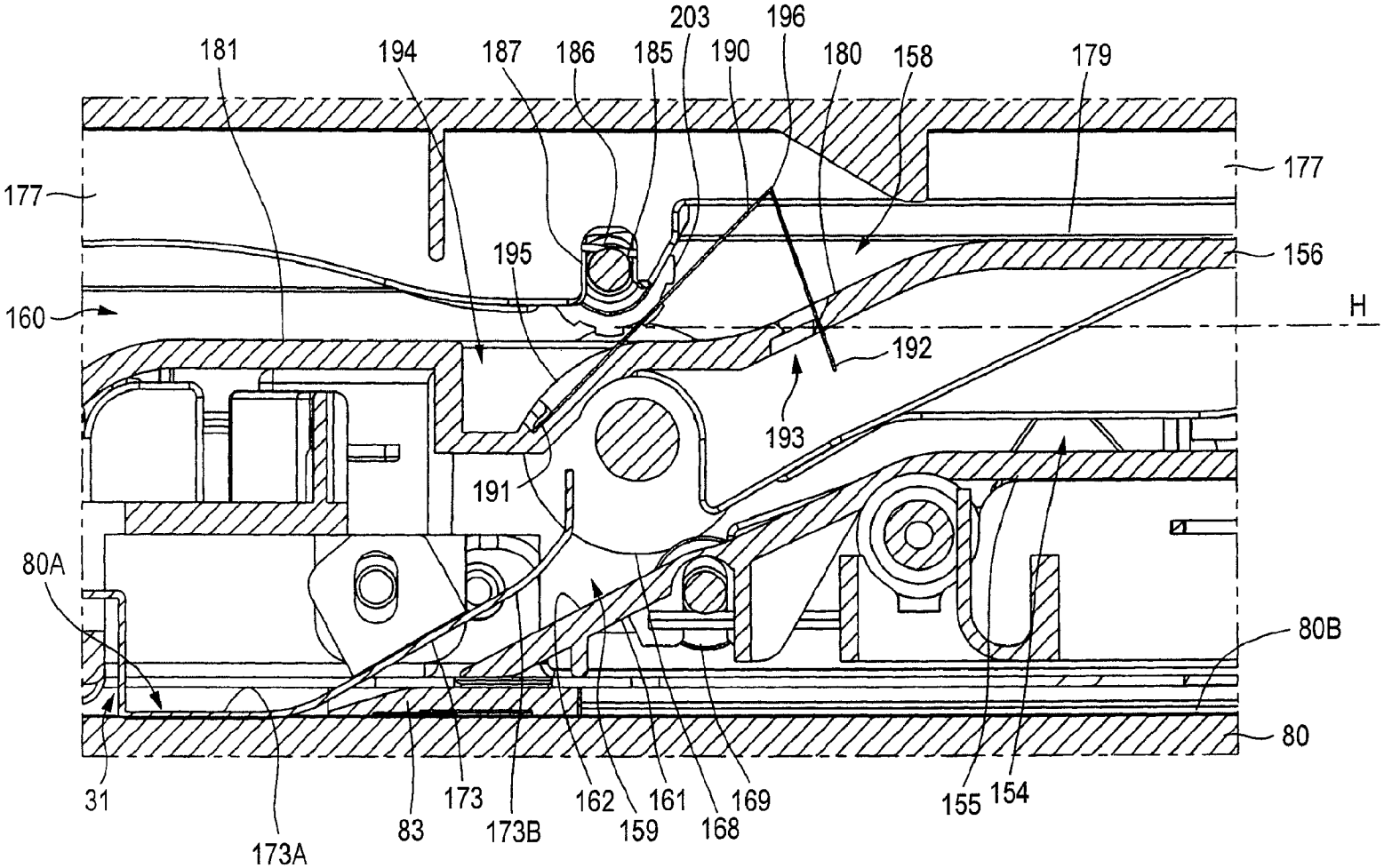
FIG. 17 is an enlarged cross-sectional view of a main portion showing a cross section taken along a line XVII-XVII shown in FIG. 9.

In the present example, as shown in FIG. 17, the sloped portion 180 is disposed at a position near to the pinch rollers 170 at a downstream side in the conveying direction with respect to the pinch rollers 170. In other words, the sloped portion 180 is provided at an immediately down stream portion of the pinch rollers 170. The sloped portion 180 is, as described above, inclined to the upper flat portion 179. As shown in the drawings, a sloping surface of the sloped portion 180 is provided to be higher at an immediately downstream portion of the spring pieces 190 than the nip position H between the first conveying rollers 168 and the pinch rollers 170. Thus, even in a state in which the trailing edge of a sheet is not lifted up by the spring pieces 190, since the trailing edge of the sheet is lifted at a position higher than the nip position H on the downstream side of the spring pieces 190, a leading edge of the sheet can be easily guided beneath the preceding sheet.

The sheet guided to the upper flat portion 179 is guided to the discharge tray 34 provided on the downstream side in the conveying direction of the sheet. As described above, the discharge tray 34 is arranged at a lower position than the top surface of the upper flat portion 179 (see FIGS. 13 and 14). Thus, although the trailing edge of the sheet discharged to the discharge tray 34 remains in the discharge chute portion 158, the leading edge of the sheet is supported by the discharge tray 34 arranged at a lower position than the upper flat portion 179. Hence, the load applied to the leading edge of the sheet increases and the load applied to the trailing edge of the sheet decreases, and thus, the trailing edge is easily lifted up.

Although the present example describes an example in which the top surface of the upper flat portion 179 horizontally extends to the downstream in the conveying direction, a sloping surface inclined downwardly toward the downstream in the conveying direction may be provided on a topside of the upper flat portion 179. The sloping surface may be inclined at a certain inclination angle or may be inclined such that the degree of inclination gradually increases toward the downstream in the conveying direction, for example.

With the configuration in which a sloping surface is thus provided to the upper flat portion 179, the load of a portion supported by the discharge chute portion 158 transfers to the leading edge of the sheet, and thus, the load applied to the trailing edge decreases and the trailing edge of the sheet is easily lifted up. Accordingly, the subsequent sheet is easily placed beneath the preceding sheet. In this case, a boundary portion between the sloped portion 180 and the upper flat portion 179 is the highest position on the partition plate 156. Thus, the trailing edge of the sheet is easily lifted up with the apex serving as a fulcrum. Note that the boundary portion described above serves as the apex.

Although not particularly described in the drawings, when the top surface of the upper flat portion 179 is configured to be horizontal, as in the present example, a projection composing the highest position on the partition plate 156 may be provided near the boundary portion between the sloped portion 180 and the upper flat portion 179. By providing such a projection, the trailing edge of the sheet is more easily lifted up with the projection serving as a fulcrum. Such projection also serves as the apex. Note that a configuration for providing the apex is not limited to the above-described configuration.

As shown in each of the accompanying drawings, the spring pieces 190 (which serve as elastic support pieces) are arranged in the discharge chute portion 158. The spring pieces 190 support the sheet discharged to the discharge chute portion 158 while elastically urging the sheet to the side of the guide ribs 177, and are formed to be bent in a substantially L-lettered shape when viewed in a cross section. The spring pieces 190 are formed of an elastic plate member made of a synthetic resin with high elasticity, such as PET (polyethylene terephthalate), with a thickness on the order of 0.2 millimeters to 1.0 millimeter.

As shown in FIGS. 14 and 15, four spring pieces 190 are arranged in the widthwise direction (an up-down direction in FIG. 15) of the discharge chute portion 158 with a predetermined interval therebetween. In the present example, to prevent interference between the spring pieces 190, and the first conveying rollers 168 and the pinch rollers 170, as shown in the drawings, one spring piece 190 is arranged between the first conveying rollers 168, and one spring piece 190 is arranged at the outer side of each of the first conveying rollers 168 that are disposed on both sides in the widthwise direction.

Figure 18:
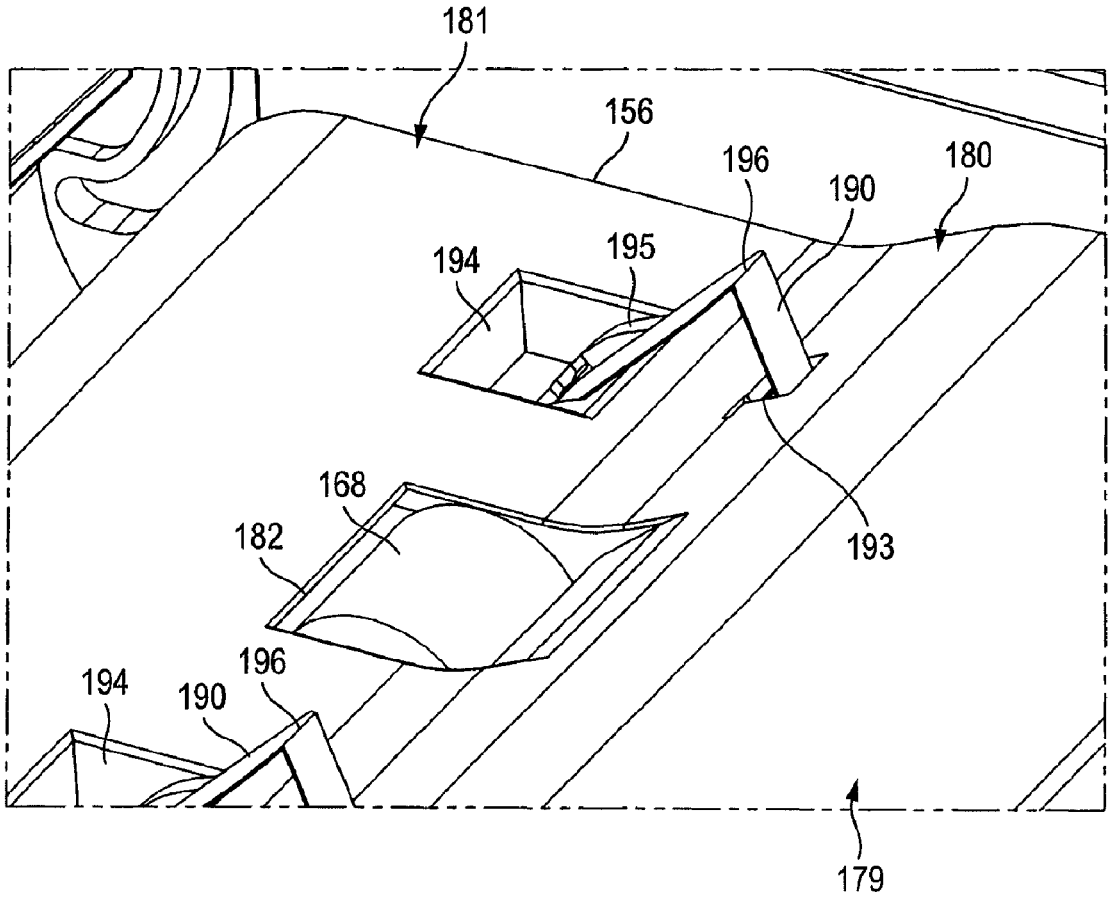
FIG. 18 is an enlarged detailed view of a first conveying roller and a spring piece.

A recess 194 for fixing a spring piece 190 is provided for each spring piece 190 in the lower flat portion 181 of the partition plate 156. As shown in FIG. 18, a wall surface 195 of a recess 194 on the downstream side in the conveying direction is inclined to the downstream side in the conveying direction. A fitting groove is formed on the wall surface 195. By a base 191 of a spring piece 190 being inserted in the fitting groove, the spring piece 190 is fixed to the partition plate 156. Note that the base 191 is part of the spring piece 190 which is fixed to be elastically deformable and the position of the base 191 is not particularly limited.

As shown in FIG. 17, the spring piece 190 is inclined from the fixed base 191 to the downstream side in the conveying direction. Furthermore, a free end 192 extending downward from a bending portion 196 of the spring piece 190 is inserted downward in a through slot 193 provided in the sloped portion 180 on the downstream side in the conveying direction of the recess 194. Accordingly, when a load is applied to the spring piece 190, the spring piece 190 is elastically deformed with respect to the fixed base 191. Specifically, the postures of the bending portion 196 and the free end 192 of the spring piece 190 are changed in an up-down motion as viewed in a cross section, according to an applied load.

As shown in FIGS. 16 and 17, the spring piece 190 thus provided is, in a natural posture, held in a posture in which the bending portion 196 enters between guide ribs 177 of the ADF cover 153. Thus, when no load is applied to the spring piece 190, the upper sheet conveying path 160 is blocked by the spring piece 190.

When the sheet conveyed through the upper sheet conveying path 160 to the downstream side in the conveying direction while being nipped between the first conveying rollers 168 and the pinch rollers 170, a leading edge of the sheet climbs up on sloping surfaces of the spring pieces 190 inclined to the downstream side in the conveying direction. At this time, the self-weight of the sheet and a conveying force (a force acting in a direction in which the sheet is pushed out) by each roller are applied to the spring pieces 190, whereby the postures of the spring pieces 190 are changed downward. Accordingly, the bending portions 196 move downward and the upper sheet conveying path 160 is opened. Accordingly, the sheet is guided within the discharge chute portion 158 to the downstream side in the conveying direction while being elastically supported on the spring pieces 190.

When the sheet is further conveyed and the trailing edge of the sheet comes out of the nip position between the first conveying rollers 168 and the pinch rollers 170, the conveying force applied to the sheet is lost at that moment. Here, only the self-weight of the trailing edge of the sheet is applied to the spring pieces 190. The spring constant of the spring pieces 190 is set such that the postures of the spring pieces 190 cannot be changed downward against the urging force of the spring pieces 190 only by the self-weight of the trailing edge of the sheet. Thus, when the trailing edge of the sheet comes out of the nip position, the trailing edge of the sheet is lifted upward by the urging force of the spring pieces 190. At this time, the trailing edge of the sheet is pressed against the guide ribs 177 by the spring pieces 190. Accordingly, the trailing edge of the sheet is nipped between the spring pieces 190 and the guide ribs 177.

When, in a state in which the trailing edge of a sheet is nipped between the spring pieces 190 and the guide ribs 177 in the above-described manner, a subsequent sheet is discharged to the discharge chute portion 158, the subsequent sheet is conveyed while pressing down the spring pieces 190, as with a preceding discharged sheet. At this time, since the sheet discharged by the rollers is conveyed upward at a predetermined angle, while a leading edge of a subsequent sheet presses the trailing edge of the preceding discharged sheet upward, the subsequent sheet enters to be placed beneath the trailing edge of the preceding discharged sheet along the sloping surfaces of the spring pieces 190. Hence, even if a large number of sheets have been discharged, the subsequent sheet can easily enter beneath the stack of discharged sheets.

Next, the support structure of the pinch rollers 170 and a detailed configuration of the pinch rollers 170 will be described.

As shown in FIG. 14, the pinch rollers 170 are mounted on the guide ribs 177 formed on the backside of the ADF cover 177. In the present example, three pinch rollers 170 are arranged to correspond to the number of the first conveying rollers 168 being arranged. The rotary shaft 185 is inserted in a shaft center of each of the pinch rollers 170. Thus, the rotary shaft 185 serves as a shared shaft of the plurality of pinch rollers 170.

The rotary shaft 185 is made of a metal round bar that is sufficiently long, for example. Both ends of the rotary shaft 185 are freely supported by shaft receiving portions 197 provided on both sides, in the widthwise direction, of the ADF cover 153, respectively. Accordingly, the rotary shaft 185 is supported to span in the widthwise direction of the ADF cover 153. Since the pinch rollers 170 are thus rotatably supported on the shared rotary shaft 185, the number of components can be reduced by omission and assembling of pinch rollers can be facilitated.

Figure 19:
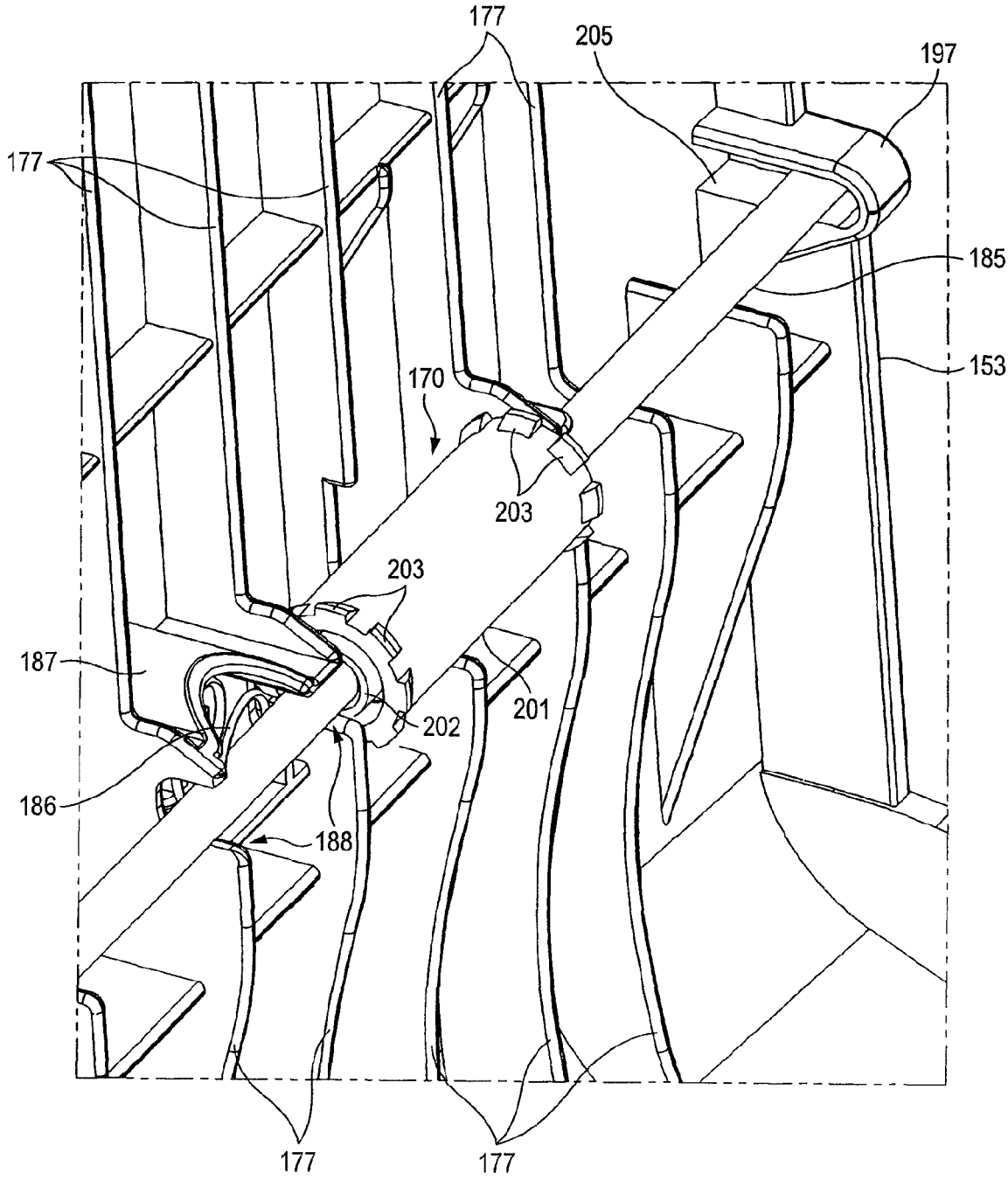
FIG. 19 is a partial enlarged view showing a state in which a pinch roller is mounted on guide ribs.

As shown in FIGS. 14 and 19, a groove 205 extending in a direction perpendicular to the backside of the ADF cover 153 is formed in a shaft receiving portion 197. The rotary shaft 185 is rotatably supported such that ends, in an axial direction, of the rotary shaft 185 are inserted in the grooves 205. Thus, the rotary shaft 185 can slide and move in the direction perpendicular to the backside of the ADF cover 153 while being rotatably supported on the backside of the ADF cover 153.

As shown in FIG. 14, spring receiving portions 187 are formed between the three pinch rollers 170 provided on the guide ribs 177. That is, two spring receiving portions 187 in total are formed at positions corresponding to the rotary shaft 185 on the guide ribs 177.

As shown in FIG. 19, a spring receiving portion 187 is formed by concaving a part of a guide rib 177. Slits 188 are formed in sidewalls of the spring receiving portion 187 in the axial direction of the pinch rollers 170. The slits 188 are cut out in the direction perpendicular to the backside of the ADF cover 153. The groove width of the slits 188 is slightly larger than the diameter of the rotary shaft 185 and the rotary shaft 185 is inserted in the slits 188. The moving direction of the rotary shaft 185 is regulated by the slits 188 in the direction perpendicular to the backside of the ADF cover 153, whereby the position of the rotary shaft 185 is prevented from being shifted to the conveying direction of the sheets.

A coil spring 186 is accommodated in each spring receiving portion 187. The coil springs 186 are compressed with the rotary shaft 185 being rotatably supported on the shaft receiving portions 197. The rotary shaft 185 is supported while being urged by the coil springs 186. Accordingly, the rotary shaft 185 is urged to a direction substantially perpendicular to the backside of the ADF cover 153. Thus, when the ADF cover 153 is closed over the ADF main body 152, the pinch rollers 170 are urged to a direction close to the first conveying rollers 168 and contacts the roller surfaces of the first conveying rollers 168.

Note that the spring constant of the coil springs 186 is set to a value at which when the sheet passes through a position where the first conveying rollers 168 contacts the pinch rollers 170 the coil springs 186 are retractable according to the thickness of the sheet.

As described above, the plurality of pinch rollers 170 are supported by the shared rotary shaft 185 and the rotary shaft 185 is urged by the coil springs 186. Therefore, urging forces against the pinch rollers 170 become uniform. As a result, contact forces against the first conveying rollers 168 are uniformalized. Accordingly, skewing of the sheet caused by non-uniform contact forces can be prevented.

Figure 20:
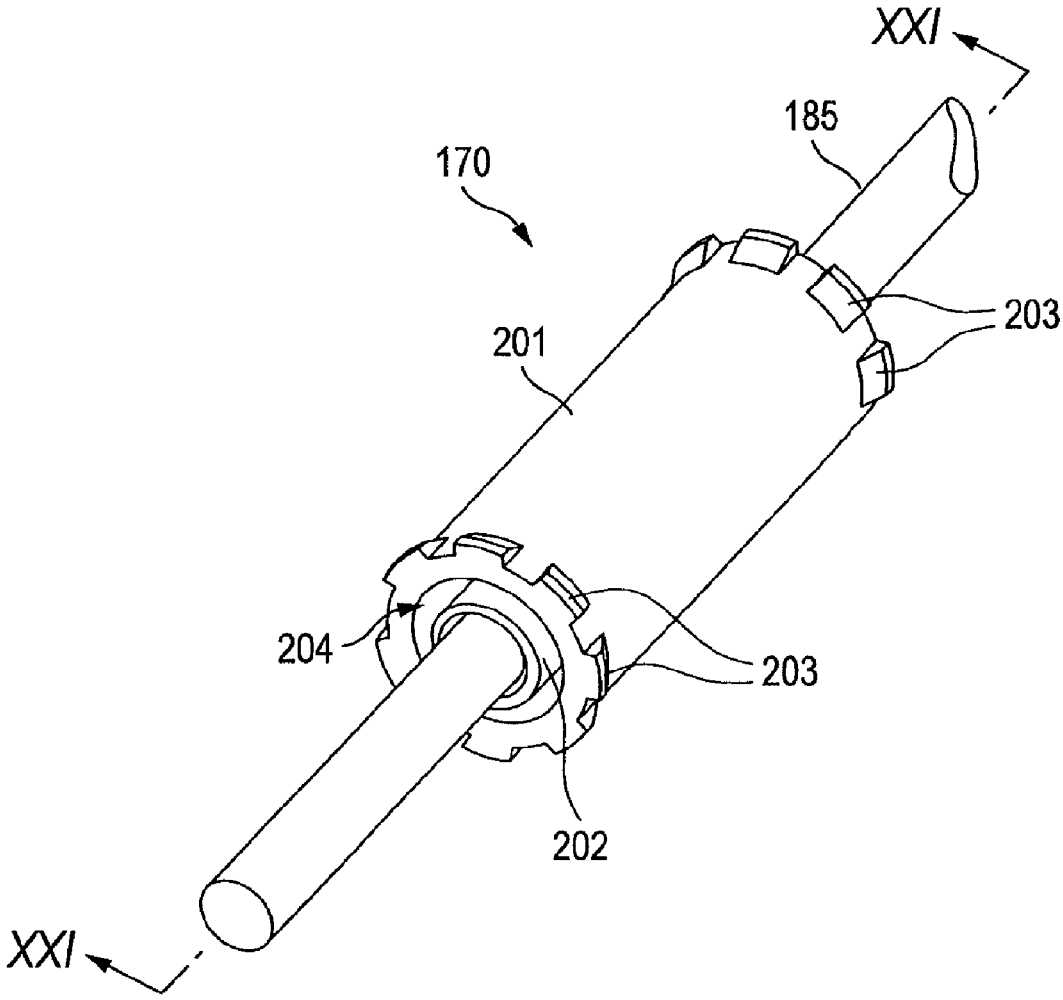
FIG. 20 is an enlarged detailed view of the pinch roller.
Figure 21A:
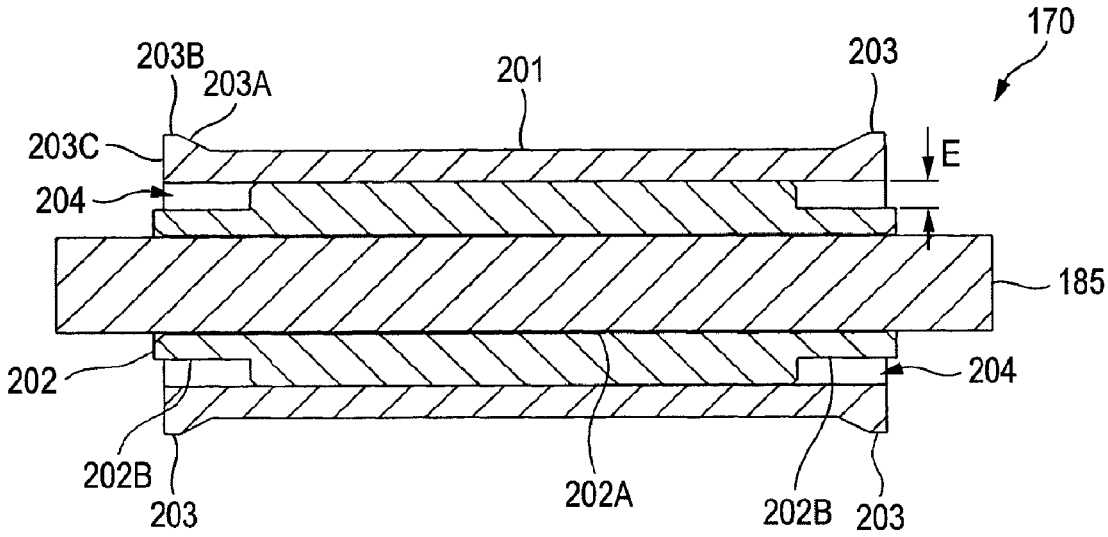
FIG. 21A is a cross-sectional view showing a cross section taken along a line XXI-XXI shown in FIG. 20.
Figure 21B:
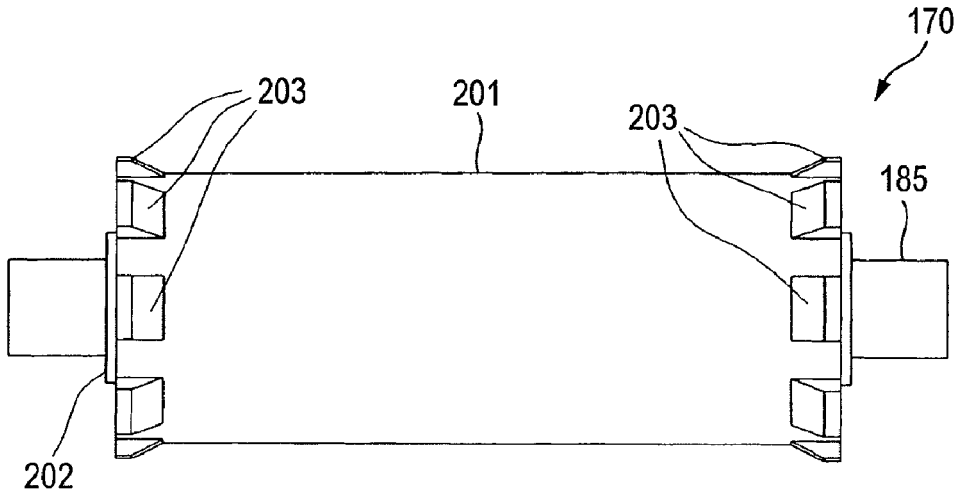
FIG. 21B is a front view of the pinch roller.

As shown in FIGS. 20, 21A and 21B, a pinch roller 170 includes an outer roller body 201 and an inner roller body 202. The inner roller body 202 and the outer roller body 201 are roughly formed in a cylindrical shape that is elongated in an axial direction.

The inner roller body 202 is formed by a synthetic resin using a molding die, for example. The diameter of an inner hole of the inner roller body 202 is substantially the same size as the outer diameter of the rotary shaft 185. Due to the rotary shaft 185 being inserted into the inner hole of the inner roller body 202, the inner roller body 202 is rotatably supported on the rotary shaft 185. The outer diameter of the inner roller body 202 is substantially the same size as the diameter of an inner hole of the outer roller body 201, in a large region including an axial direction central portion 202A. On the other hand, the outer diameter of the axial direction both ends 202B of the inner roller body 202 has a smaller diameter than the diameter of the inner hole of the outer roller body 201. Thus, the axial direction both ends 2023 of the inner roller body 202 have formed therein a step that is recessed in a diameter direction from the axial direction central portion 202A by a difference E between the radius of the axial direction both ends 202B of the inner roller body 202 and the radius of the axial direction central portion 202A, as viewed in a cross section. The step of the difference E is set to substantially match the amount of projection of a projection 203, as will be described later. The length, in the axial direction, of the axial direction both ends 202B with a reduced diameter is set to substantially match the length, in the axial direction, of a projection 203, as will be described later.

The outer roller body 201 is formed to be slightly shorter in the axial direction than the inner roller body 202. The outer roller body 201 is formed of an elastically deformable member like a rubber material such as BR (Butadiene Rubber) and NBR (nitrile rubber, acrylonitrile-butadiene rubber). Hence, the coefficient of friction of a roller surface of the outer roller body 201 is relatively high, and thus it is suitable to convey the sheet. The diameter of the inner hole of the outer roller body 201 is substantially the same size as the outer diameter of the axial direction central portion 202A of the inner roller body 202.

A pinch roller 170 is formed by the inner roller body 202 being disposed into an inner hole of the outer roller body 201. A wall surface of the inner hole of the outer roller body 201 is formed to be a uniform surface. Thus, since a step is formed in the axial direction both ends 202B of the inner roller body 202, with the inner roller body 202 fitting in the outer roller body 201, a gap 204 equivalent to the difference E is provided on the inner side of both ends of the pinch roller 170.

On axial direction both ends of the outer roller body 201, a plurality of paddle-like projections 203 (which serve as paddle portions) which project in the diameter direction of the outer roller body 201 from the roller surface are provided. The projections 203 are radially arranged along an outer circumferential direction of the outer roller body 201 with an appropriate gap therebetween. In the present examples a projection 203 shows a substantially wedge shape when viewed in a cross section, having a sloping surface 203A inclined outwardly in the axial direction, a parallel surface 203B parallel to the roller surface, and a surface 203C which is the same as a side surface of the outer roller body 201. However, the projection 203 is not particularly limited to such a shape as long as the projection 203 projects from the roller surface. For example, the projection 203 may have a pin-like or bump-like structure. Alternatively, the projection 203 may have a wave-like or spur-like structure that continues along the outer circumference, as viewed in a cross section.

Figure 22:
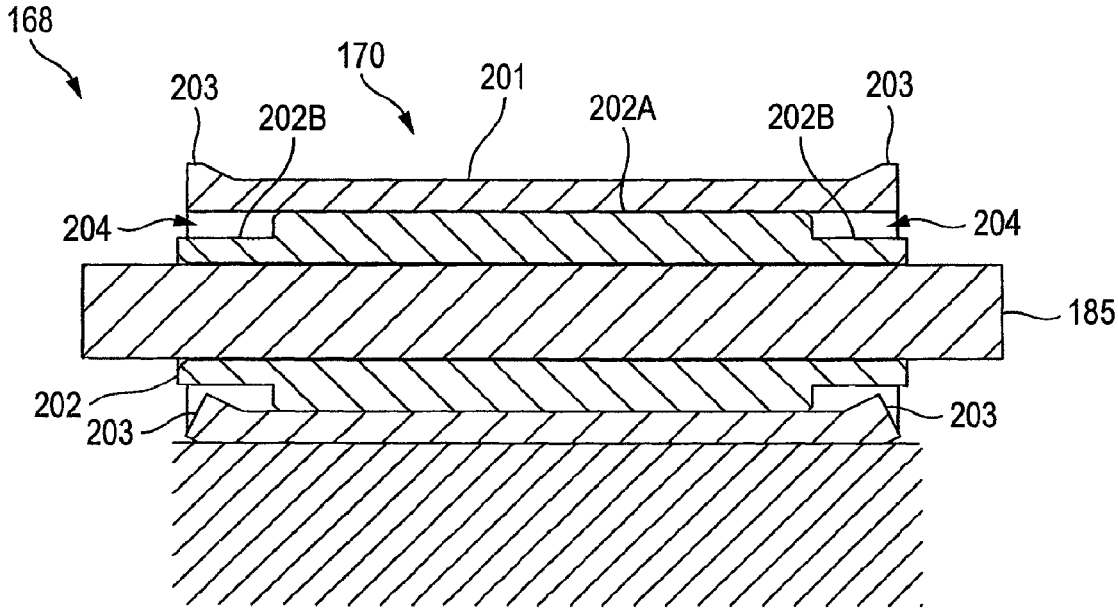
FIG. 22 is a cross-sectional view showing a retraction state of projections of the pinch roller.
Figure 23:
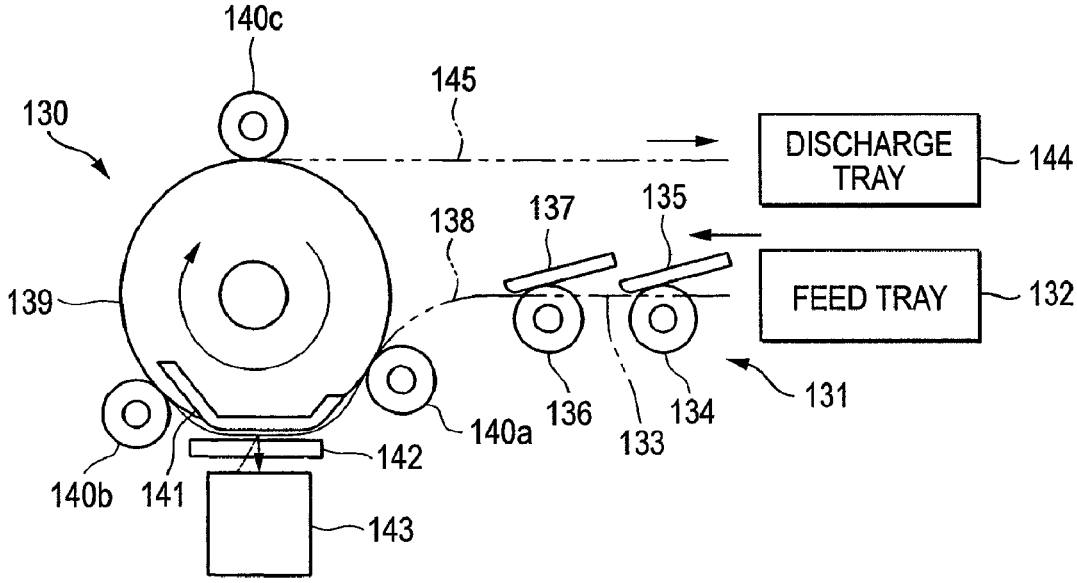
FIG. 23 is a schematic diagram showing a schematic configuration of a conventional ADF.
Figure 24A:
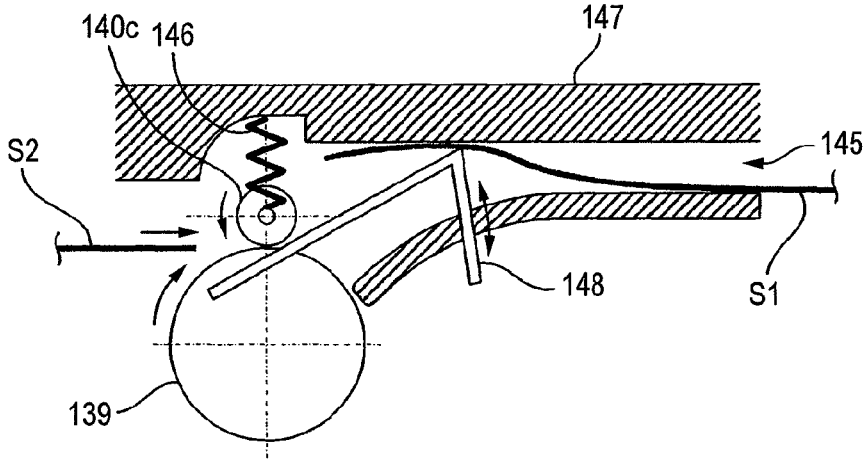
FIGS. 24A-24C are diagrams for describing a conveyance of a sheet in the conventional ADF.
Figure 24B:
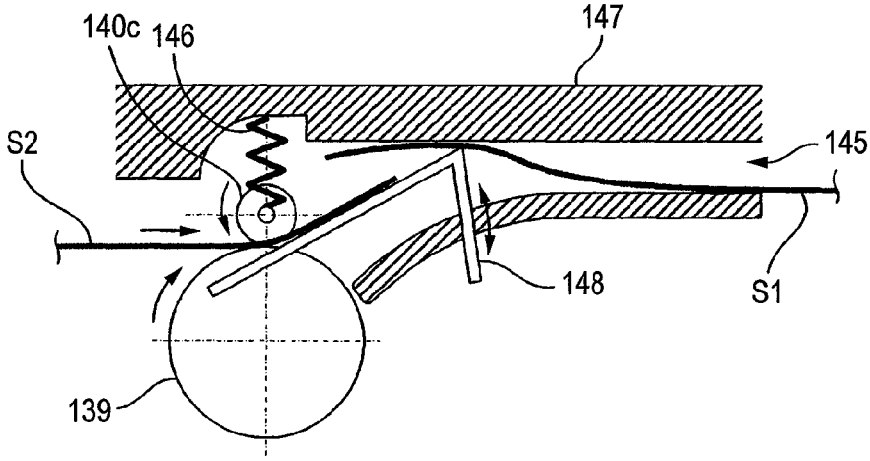
Figure 24C:
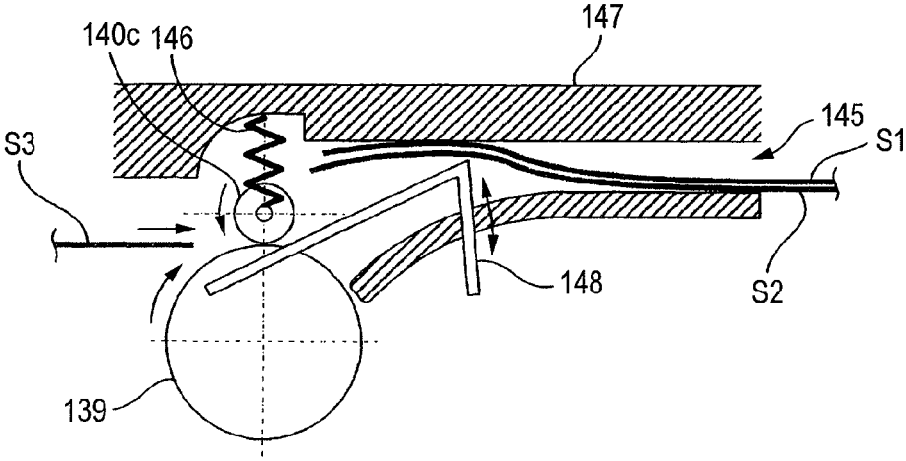

Since such projections 203 are provided on the axial direction ends of an outer roller body 201, the trailing edge of the sheet that came out of the nip position between the first conveying rollers 168 and the pinch rollers 107 is easily scraped upward. As a result, the subsequent sheet is easily placed beneath the preceding sheet. Upon conveying the sheet, the sheet may be damaged by the projections 203 pressing against the sheet. However, the pinch rollers 170 adopted in the present example have, as described above, the gap 204 provided therein, and thus, in a state in which the pinch rollers 170 are in contact with the first conveying rollers 168 by pressure, as shown in FIG. 22, the projections 203 are retracted inward. Accordingly, damage to the sheet by the projections 203 does not occur.

It is to be understood that the above-described example is merely an example of the present invention and, as a matter of course, the example can be appropriately changed without departing from the spirit and scope of the present invention.

What is claimed is:

1. A sheet conveying device comprising:

a sheet conveying path that is defined by guide surfaces that face each other with a predetermined gap therebetween and through which a sheet is conveyed;

a pair of discharge rollers that are provided at a position most downstream in a conveying direction of the sheet conveying path and discharges the sheet from the sheet conveying path, the discharge rollers including:

a drive roller that rotates by a torque applied thereto; and a follower roller that contacts the drive roller and rotates in accordance with the rotation of the drive roller;

a discharge chute portion that guides the sheet discharged from the conveying path by the discharge rollers toward downstream in the conveying direction, the discharge chute portion including an upper discharge guide and a lower discharge guide that face each other with a predetermined gap therebetween;

an elastic support piece that is provided in the discharge chute portion and supports a trailing edge of the sheet discharged to the discharge chute portion while elastically urging the trailing edge toward the upper discharge guide; and a discharge tray that is provided from the discharge chute portion and retains the sheet guided by the discharge chute portion, wherein a lower one of the guide surfaces defining the sheet conveying path extends horizontally from the discharge rollers toward upstream in the conveying direction, and wherein the pair of discharge rollers are arranged such that a line connecting a center of the drive roller and a center of the follower roller is inclined toward upstream in the conveying direction with respect to a line passing through the center of the drive roller and normal to the lower one of the guide surfaces.

2. The sheet conveying device according to claim 1, wherein the discharge tray is disposed at a position lower than a guide surface of the lower discharge guide of the discharge chute portion.

3. The sheet conveying device according to claim 1, wherein the lower discharge guide of the discharge chute portion has an upper guide surface disposed at a position higher than a position where the pair of discharge rollers contact each other.

4. The sheet conveying device according to claim 3, wherein the upper guide surface is disposed at an upstream portion of the lower discharge guide in the conveying direction, the upstream position being downstream in the conveying direction with respect to the elastic support piece.

5. The sheet conveying device according to claim 3, wherein the upper guide surface forms an apex of the guide surface of the lower discharge guide.

6. The sheet conveying device according to claim 1, wherein the lower discharge guide of the discharge chute portion is inclined downward toward downstream in the conveying direction.

7. The sheet conveying device according to claim 1, wherein the follower roller is provided with paddle portions that project radially from a roller surface of the follower roller at both ends of the follower roller in an axial direction.

8. The sheet conveying device according to claim 7, wherein the follower roller includes a cylindrical outer body provided with the paddle portions, and a cylindrical inner body enclosed by the cylindrical outer body, and a gap is formed, at both ends of the follower roller, between an inner surface of the cylindrical outer body and an outer surface of the cylindrical inner body such that the paddle portions retract into the gap when the follower roller is pressed against the drive roller.

9. The sheet conveying device according to claim 1, wherein a plurality of pairs of the discharge rollers are arranged coaxially in a widthwise direction of the sheet conveying path with a predetermined interval between each of the pairs of the discharge rollers, the widthwise direction being a direction perpendicular to the conveying direction.

10. The sheet conveying device according to claim 9, wherein each of the follower rollers of the pairs of the discharge rollers is rotatably supported by a common shaft that is urged toward the drive rollers of the pairs of the discharge rollers.

11. The sheet conveying device according to claim 9, wherein a plurality of the elastic support pieces are arranged in the widthwise direction of the discharge chute portion with a predetermined interval between one another.

12. The sheet conveying device according to claim 11, wherein each of the elastic support pieces is arranged at positions including:

a first position that is between positions where the pairs of discharge rollers are disposed; and a second position that is more outward in an axial direction of the discharge rollers than the discharge rollers that are disposed at outer positions in the widthwise direction of the sheet conveying path.

13. The sheet conveying device according to claim 1, further comprising:

a main body; and a cover member that is arranged on the main body to be opened and closed with respect to the main body, wherein the cover member serves as an upper conveying guide forming an upper one of the guide surfaces of the sheet conveying path and as the upper discharge guide of the discharge chute portion, wherein the drive roller is provided on the main body, and wherein the follower roller is rotatably provided on the upper conveying guide.

14. The sheet conveying device according to claim 1, wherein a plurality of the elastic support pieces are arranged in a widthwise direction of the discharge chute portion with a predetermined interval between one another, the widthwise direction being a direction perpendicular to the conveying direction.

15. The sheet conveying device according to claim 1, wherein the elastic support piece is made of a plate member that is inclined toward downstream in the conveying direction, the plate member having a base end that is fixed to the lower discharge guide.

16. The sheet conveying device according to claim 1, further comprising;

a feed tray on which a stack of sheets to be conveyed are placed, the feed tray being disposed below the discharge tray; and a sheet feeding mechanism that sequentially takes out the bottommost sheet one by one from the stack of sheets and feeds the sheet to the sheet conveying path, wherein the sheet conveying path is formed to have a U-lettered shape that extends from the feed tray, curves upward and toward the discharge tray.

17. The sheet conveying device according to claim 1, wherein the drive roller projects from the lower one of the guide surfaces upward toward the follower roller.

18. The sheet conveying device according to claim 1, wherein the lower discharge guide of the discharge chute portion includes a horizontal surface higher than the lower one of the guide surfaces, and a sloped surface formed between the one of the guide surface and the horizontal surface in the conveying direction.

19. An image scanning apparatus comprising;

a sheet conveying device that conveys a sheet; and an image scanning device that scans an image formed on the sheet, wherein the sheet conveying device comprises:

a sheet conveying path that is defined by guide surfaces that face each other with a predetermined gap therebetween and through which the sheet is conveyed;

a pair of discharge rollers that is are provided at a position most downstream in a conveying direction of the sheet conveying path and discharges the sheet from the sheet conveying path, the discharge rollers including:

a drive roller that rotates by a torque applied thereto; and a follower roller that contacts the drive roller and rotates in accordance with the rotation of the drive roller;

a discharge chute portion that guides the sheet discharged from the conveying path by the discharge rollers toward downstream in the conveying direction, the discharge chute portion including an upper discharge guide and a lower discharge guide that face each other with a predetermined gap therebetween;

an elastic support piece that is provided in the discharge chute portion and supports a trailing edge of the sheet discharged to the discharge chute portion while elastically urging the trailing edge toward the upper discharge guide; and a discharge tray that is provided from the discharge chute portion and retains the sheet guided by the discharge chute portion, wherein a lower one of the guide surfaces defining the sheet conveying path extends horizontally from the discharge rollers toward upstream in the conveying direction, and wherein the pair of discharge rollers are arranged such that a line connecting a center of the drive roller and a center of the follower roller is inclined toward upstream in the conveying direction with respect to a line passing through the center of the drive roller and normal to the lower one of the guide surfaces, and wherein the image scanning device is disposed below a sheet scanning position along the sheet conveying path.

* * * * *